US012000273B2

(12) United States Patent
Yi et al.

(10) Patent No.: US 12,000,273 B2
(45) Date of Patent: Jun. 4, 2024

(54) METHOD AND SYSTEM FOR PERFORMING HYDROCARBON OPERATIONS USING COMMUNICATIONS ASSOCIATED WITH COMPLETIONS

(71) Applicant: ExxonMobil Technology and Engineering Company, Spring, TX (US)

(72) Inventors: Xiaohua Yi, Houston, TX (US); Steven D. Vande Lune, Spring, TX (US); Michael D. Barry, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 108 days.

(21) Appl. No.: 16/175,488

(22) Filed: Oct. 30, 2018

(65) Prior Publication Data

US 2019/0153857 A1 May 23, 2019

Related U.S. Application Data

(60) Provisional application No. 62/588,103, filed on Nov. 17, 2017.

(51) Int. Cl.
*E21B 43/04* (2006.01)
*E21B 47/06* (2012.01)
(Continued)

(52) U.S. Cl.
CPC ..... *E21B 47/14* (2013.01); *E21B 43/04* (2013.01); *E21B 47/06* (2013.01); *E21B 47/16* (2013.01); *E21B 47/017* (2020.05); *E21B 47/13* (2020.05)

(58) Field of Classification Search
CPC ... E21B 43/02–088; E21B 47/14; E21B 47/17
See application file for complete search history.

(56) References Cited

U.S. PATENT DOCUMENTS 3,103,643 A 9/1963 Kalbfell ..... 340/17
3,205,477 A 9/1965 Kalbfell ..... 340/18
(Continued)

FOREIGN PATENT DOCUMENTS

CN 102733799 6/2014 ..... E21B 47/16
EP 0636763 2/1995 ..... E21B 47/12
(Continued)

OTHER PUBLICATIONS

U.S. Appl. No. 15/666,334, filed Aug. 1, 2017, Walker, Katie M et al.

(Continued)

*Primary Examiner* — Robert E Fuller
*Assistant Examiner* — Lamia Quaim
(74) *Attorney, Agent, or Firm* — ExxonMobil Technology and Engineering Company—Law Department

(57) ABSTRACT

A method and system are described for communicating within a system, which may be along tubular members and used during gravel pack operations. The method includes constructing a communication network and installing the communication nodes along the gravel pack system. The communication nodes are used to monitor the formation of the gravel pack for voids or gaps during the gravel pack operations. Once the gravel pack is installed, the gravel pack operations may be used for hydrocarbon operations, such as hydrocarbon exploration, hydrocarbon development, and/or hydrocarbon production.

20 Claims, 8 Drawing Sheets

(51) Int. Cl.

| | |
|---|---|
| ***E21B 47/14*** | (2006.01) |
| ***E21B 47/16*** | (2006.01) |
| *E21B 47/017* | (2012.01) |
| *E21B 47/13* | (2012.01) |

(56) References Cited

U.S. PATENT DOCUMENTS

| | | | | |
|---|---|---|---|---|
| 3,512,407 | A | 5/1970 | Zill | 73/152 |
| 3,637,010 | A | 1/1972 | Malay et al. | 166/51 |
| 3,741,301 | A | 6/1973 | Malay et al. | 166/191 |
| 3,781,783 | A | 12/1973 | Tucker | 340/18 |
| 3,790,930 | A | 2/1974 | Lamel et al. | 340/18 |
| 3,900,827 | A | 8/1975 | Lamel et al. | 340/18 |
| 3,906,434 | A | 9/1975 | Lamel et al. | 340/18 |
| 4,001,773 | A | 1/1977 | Lamel et al. | 340/18 |
| 4,283,780 | A | 8/1981 | Nardi | 367/82 |
| 4,298,970 | A | 11/1981 | Shawhan et al. | 367/82 |
| 4,302,826 | A | 11/1981 | Kent et al. | 367/82 |
| 4,314,365 | A | 2/1982 | Peterson et al. | 367/82 |
| 4,884,071 | A | 11/1989 | Howard | 340/854 |
| 4,962,489 | A | 10/1990 | Medlin et al. | 367/32 |
| 5,113,935 | A * | 5/1992 | Jones | E21B 43/04 166/278 |
| 5,128,901 | A | 7/1992 | Drumheller | 367/82 |
| 5,136,613 | A | 8/1992 | Dumestre, III | 375/1 |
| 5,166,908 | A | 11/1992 | Montgomery | 367/165 |
| 5,182,946 | A | 2/1993 | Boughner et al. | 73/151 |
| 5,234,055 | A | 8/1993 | Cornette | 166/278 |
| 5,283,768 | A | 2/1994 | Rorden | 367/83 |
| 5,373,481 | A | 12/1994 | Orban et al. | 367/82 |
| 5,468,025 | A | 11/1995 | Adinolfe et al. | 285/114 |
| 5,480,201 | A | 1/1996 | Mercer | 294/67.31 |
| 5,495,230 | A | 2/1996 | Lian | 340/551 |
| 5,562,240 | A | 10/1996 | Campbell | 227/130 |
| 5,592,438 | A | 1/1997 | Rorden et al. | 367/83 |
| 5,667,650 | A | 9/1997 | Face et al. | 204/298.07 |
| 5,850,369 | A | 12/1998 | Rorden et al. | 367/83 |
| 5,857,146 | A | 1/1999 | Kido | 455/38.3 |
| 5,924,499 | A | 7/1999 | Birchak et al. | 175/40 |
| 5,960,883 | A | 10/1999 | Tubel et al. | 166/313 |
| 5,995,449 | A | 11/1999 | Green et al. | 367/83 |
| 6,049,508 | A | 4/2000 | Deflandre | 367/48 |
| 6,125,080 | A | 9/2000 | Sonnenschein et al. | 367/134 |
| 6,128,250 | A | 10/2000 | Reid et al. | 367/153 |
| 6,177,882 | B1 | 1/2001 | Ringgenberg et al. | 340/853.7 |
| 6,236,850 | B1 | 5/2001 | Desai | 455/343 |
| 6,239,690 | B1 | 5/2001 | Burbidge et al. | 340/10.33 |
| 6,300,743 | B1 | 10/2001 | Patino et al. | 320/106 |
| 6,320,820 | B1 | 11/2001 | Gardner et al. | 367/81 |
| 6,324,904 | B1 | 12/2001 | Ishikawa et al. | 73/152.03 |
| 6,360,769 | B1 | 3/2002 | Brisco | 137/268 |
| 6,394,184 | B2 | 5/2002 | Tolman et al. | 166/281 |
| 6,400,646 | B1 | 6/2002 | Shah et al. | 367/82 |
| 6,429,784 | B1 | 8/2002 | Beique et al. | 340/853.2 |
| 6,462,672 | B1 | 10/2002 | Besson | 340/853.2 |
| 6,543,538 | B2 | 4/2003 | Tolman et al. | 166/284 |
| 6,670,880 | B1 | 12/2003 | Hall et al. | 336/132 |
| 6,679,332 | B2 | 1/2004 | Vinegar et al. | 166/373 |
| 6,695,277 | B1 | 2/2004 | Gallis | 241/191 |
| 6,702,019 | B2 | 3/2004 | Dusterhoft et al. | 166/278 |
| 6,717,501 | B2 | 4/2004 | Hall et al. | 336/132 |
| 6,727,827 | B1 | 4/2004 | Edwards et al. | 340/854.9 |
| 6,745,012 | B1 | 6/2004 | Ton et al. | |
| 6,772,837 | B2 | 8/2004 | Dusterhoft et al. | 166/278 |
| 6,816,082 | B1 | 11/2004 | Laborde | 340/853.3 |
| 6,868,037 | B2 | 3/2005 | Dasgupta et al. | 367/54 |
| 6,880,634 | B2 | 4/2005 | Gardner et al. | 166/250.01 |
| 6,883,608 | B2 | 4/2005 | Parlar et al. | 166/278 |
| 6,899,178 | B2 | 5/2005 | Tubel | 166/313 |
| 6,909,667 | B2 | 6/2005 | Shah et al. | 367/83 |
| 6,912,177 | B2 | 6/2005 | Smith | 367/82 |
| 6,920,085 | B2 | 7/2005 | Finke et al. | 367/83 |
| 6,930,616 | B2 | 8/2005 | Tang et al. | 340/854.4 |
| 6,940,392 | B2 | 9/2005 | Chan et al. | 340/10.4 |
| 6,940,420 | B2 | 9/2005 | Jenkins | 340/855.6 |
| 6,953,094 | B2 | 10/2005 | Ross et al. | 166/381 |
| 6,956,791 | B2 | 10/2005 | Dopf et al. | 367/82 |
| 6,980,929 | B2 | 12/2005 | Aronstam et al. | 702/188 |
| 6,987,463 | B2 | 1/2006 | Beique et al. | 340/856.3 |
| 7,006,918 | B2 | 2/2006 | Economides et al. | 702/1 |
| 7,011,157 | B2 | 3/2006 | Costley et al. | 166/311 |
| 7,036,601 | B2 | 5/2006 | Berg et al. | 166/385 |
| 7,051,812 | B2 | 5/2006 | McKee et al. | 166/305.1 |
| 7,064,676 | B2 | 6/2006 | Hall et al. | 350/853.1 |
| 7,082,993 | B2 | 8/2006 | Ayoub et al. | 166/250.1 |
| 7,090,020 | B2 | 8/2006 | Hill et al. | 166/373 |
| 7,140,434 | B2 | 11/2006 | Chouzenoux et al. | 166/250.11 |
| 7,219,762 | B2 | 5/2007 | James et al. | 181/105 |
| 7,224,288 | B2 | 5/2007 | Hall et al. | 340/853.7 |
| 7,228,902 | B2 | 6/2007 | Oppelt | 166/250.02 |
| 7,249,636 | B2 | 7/2007 | Ohmer | 166/383 |
| 7,252,152 | B2 | 8/2007 | LoGiudice et al. | 166/386 |
| 7,257,050 | B2 | 8/2007 | Stewart et al. | 367/82 |
| 7,261,154 | B2 | 8/2007 | Hall et al. | 166/242.2 |
| 7,261,162 | B2 | 8/2007 | Deans et al. | 166/336 |
| 7,275,597 | B2 | 10/2007 | Hall et al. | 166/297 |
| 7,277,026 | B2 | 10/2007 | Hall et al. | 340/854.8 |
| RE40,032 | E | 1/2008 | van Borkhorst et al. | 455/343.2 |
| 7,317,990 | B2 | 1/2008 | Sinha et al. | 702/6 |
| 7,321,788 | B2 | 1/2008 | Addy et al. | 455/574 |
| 7,322,416 | B2 | 1/2008 | Burris, II et al. | 166/308.1 |
| 7,325,605 | B2 | 2/2008 | Fripp et al. | 166/250.01 |
| 7,339,494 | B2 | 3/2008 | Shah et al. | 340/855.7 |
| 7,348,893 | B2 | 3/2008 | Huang et al. | 340/854.3 |
| 7,373,978 | B2 | 5/2008 | Barry et al. | |
| 7,385,523 | B2 | 6/2008 | Thomeer et al. | 340/854.8 |
| 7,387,165 | B2 | 6/2008 | Lopez de Cardenas et al. | 166/313 |
| 7,411,517 | B2 | 8/2008 | Flanagan | 340/854.4 |
| 7,477,160 | B2 | 1/2009 | Lemenager et al. | 340/853.1 |
| 7,516,792 | B2 | 4/2009 | Lonnes et al. | 166/308.1 |
| 7,551,057 | B2 | 6/2009 | King et al. | 340/5.72 |
| 7,590,029 | B2 | 9/2009 | Tingley | 367/82 |
| 7,595,737 | B2 | 9/2009 | Fink et al. | 340/854.4 |
| 7,602,668 | B2 | 10/2009 | Liang et al. | 367/25 |
| 7,649,473 | B2 | 1/2010 | Johnson et al. | 340/853.1 |
| 7,750,808 | B2 | 7/2010 | Masino et al. | 340/572.1 |
| 7,775,279 | B2 | 8/2010 | Marya et al. | 166/297 |
| 7,787,327 | B2 | 8/2010 | Tang et al. | 367/27 |
| 7,819,188 | B2 | 10/2010 | Auzerais et al. | 155/250 |
| 7,828,079 | B2 | 11/2010 | Oothoudt | 175/20 |
| 7,831,283 | B2 | 11/2010 | Ogushi et al. | 455/574 |
| 7,913,773 | B2 | 3/2011 | Li et al. | 175/40 |
| 7,952,487 | B2 | 5/2011 | Montebovi | 340/636.1 |
| 7,994,932 | B2 | 8/2011 | Huang et al. | 340/854.3 |
| 8,004,421 | B2 | 8/2011 | Clark | 340/854.4 |
| 8,044,821 | B2 | 10/2011 | Mehta | 340/855.7 |
| 8,049,506 | B2 | 11/2011 | Lazarev | 324/333 |
| 8,115,651 | B2 | 2/2012 | Camwell et al. | 340/853.2 |
| 8,117,907 | B2 | 2/2012 | Han et al. | 73/152.58 |
| 8,157,008 | B2 | 4/2012 | Lilley | 166/253.1 |
| 8,162,050 | B2 | 4/2012 | Roddy et al. | 166/253.1 |
| 8,220,542 | B2 | 7/2012 | Whitsitt et al. | 166/278 |
| 8,237,585 | B2 | 8/2012 | Zimmerman | 340/854.6 |
| 8,242,928 | B2 | 8/2012 | Prammer | 340/853.7 |
| 8,276,674 | B2 | 10/2012 | Lopez de Cardenas et al. | 166/373 |
| 8,284,075 | B2 | 10/2012 | Fincher et al. | 340/854.4 |
| 8,284,947 | B2 | 10/2012 | Giesbrecht et al. | 381/66 |
| 8,316,936 | B2 | 11/2012 | Roddy et al. | 166/253.1 |
| 8,330,617 | B2 | 12/2012 | Chen et al. | 340/854.6 |
| 8,347,982 | B2 | 1/2013 | Hannegan et al. | 175/5 |
| 8,358,220 | B2 | 1/2013 | Savage | 340/853.1 |
| 8,376,065 | B2 | 2/2013 | Teodorescu et al. | 175/40 |
| 8,381,822 | B2 | 2/2013 | Hales et al. | 166/377 |
| 8,388,899 | B2 | 3/2013 | Mitani et al. | 422/179 |
| 8,411,530 | B2 | 4/2013 | Slocum et al. | 367/90 |
| 8,434,354 | B2 | 5/2013 | Crow et al. | 73/152.04 |
| 8,494,070 | B2 | 7/2013 | Luo et al. | 375/262 |
| 8,496,055 | B2 | 7/2013 | Mootoo et al. | 166/278 |
| 8,539,890 | B2 | 9/2013 | Tripp et al. | 109/25 |
| 8,544,564 | B2 | 10/2013 | Moore et al. | 175/50 |
| 8,552,597 | B2 | 10/2013 | Song et al. | 307/149 |
| 8,556,302 | B2 | 10/2013 | Dole | 285/367 |

(56) References Cited

U.S. PATENT DOCUMENTS 8,559,272 B2 10/2013 Wang
8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 9/2014 Purkis ..... 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2002/0196743 A1 12/2002 Sebastian et al.
2003/0056953 A1 3/2003 Tumlin et al. ..... 166/298
2003/0067940 A1 4/2003 Edholm
2003/0117896 A1 6/2003 Sakuma et al. ..... 367/81
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0269083 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2006/0187755 A1 8/2006 Tingley
2007/0068675 A1* 3/2007 Barry ..... C09K 8/02 166/278
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0254604 A1 11/2007 Kim ..... 455/88
2007/0272411 A1 11/2007 Lopez de Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 73/152.28
2010/0112631 A1 5/2010 Hur et al. ..... 435/39
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1* 2/2012 Wassouf ..... E21B 31/00 166/250.01
2012/0126992 A1 5/2012 Rodney et al. ..... 340/850
2012/0152562 A1 6/2012 Newton et al. ..... 166/369
2012/0179377 A1 7/2012 Lie ..... 702/6
2013/0000981 A1 1/2013 Grimmer et al. ..... 175/45
2013/0003503 A1 1/2013 L'Her et al. ..... 367/106
2013/0106615 A1 5/2013 Prammer ..... 340/854.6
2013/0138254 A1 5/2013 Seals et al. ..... 700/282
2013/0192823 A1 8/2013 Barrilleaux et al. ..... 166/250.01
2013/0278432 A1 10/2013 Shashoua et al. ..... 340/853.7
2013/0319102 A1 12/2013 Riggenberg et al. ..... 73/152.28
2014/0060840 A1 3/2014 Hartshorne et al. ..... 166/300
2014/0062715 A1 3/2014 Clark ..... 340/853.2
2014/0102708 A1 4/2014 Purkis et al. ..... 166/308.1
2014/0133276 A1 5/2014 Volker et al. ..... 367/82
2014/0152659 A1 6/2014 Davidson et al. ..... 345/420
2014/0153368 A1 6/2014 Bar-Cohen et al. ..... 367/81
2014/0166266 A1 6/2014 Read ..... 166/250.01
2014/0170025 A1 6/2014 Weiner et al. ..... 422/82.01
2014/0266769 A1 9/2014 van Zelm ..... 340/854.3
2014/0327552 A1 11/2014 Filas et al. ..... 340/854.6
2014/0352955 A1 12/2014 Tubel et al. ..... 166/250.15
2015/0003202 A1 1/2015 Palmer et al. ..... 367/82
2015/0009040 A1 1/2015 Bowles et al. ..... 340/854.6
2015/0027687 A1 1/2015 Tubel ..... 166/72
2015/0041124 A1 2/2015 Rodriguez ..... 166/255.1
2015/0041137 A1 2/2015 Rodriguez ..... 166/301
2015/0152727 A1 6/2015 Fripp et al. ..... E21B 47/14
2015/0159481 A1 6/2015 Mebarkia et al. .... E21B 47/065
2015/0167425 A1 6/2015 Hammer et al. ..... E21B 34/06
2015/0176370 A1 6/2015 Greening et al. ..... E21B 41/00
2015/0292319 A1 10/2015 Disko et al. ..... E21B 47/16
2015/0292320 A1 10/2015 Lynk et al. ..... E21B 47/16
2015/0292321 A1* 10/2015 Keller ..... E21B 47/12 367/81
2015/0300159 A1 10/2015 Stiles et al. ..... E21B 47/16
2015/0330200 A1 11/2015 Richard et al. ..... E21B 44/00
2015/0337642 A1 11/2015 Spacek ..... E21B 44/005
2015/0354351 A1 12/2015 Morrow et al. ..... E21B 47/16

(56) References Cited

U.S. PATENT DOCUMENTS

| | | | | |
|---|---|---|---|---|
| 2015/0377016 | A1 | 12/2015 | Ahmad | E21B 47/122 |
| 2016/0010446 | A1 | 1/2016 | Logan et al. | E21B 47/122 |
| 2016/0047230 | A1 | 2/2016 | Livescu et al. | E21B 47/10 |
| 2016/0047233 | A1 | 2/2016 | Butner et al. | E21B 47/12 |
| 2016/0076363 | A1 | 3/2016 | Morrow et al. | E21B 47/12 |
| 2016/0109606 | A1 | 4/2016 | Market et al. | G01V 1/50 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |
| 2019/0112913 | A1 | 4/2019 | Song et al. | E21B 47/01 |
| 2019/0112915 | A1 | 4/2019 | Disko et al. | E21B 47/14 |
| 2019/0112916 | A1 | 4/2019 | Song et al. | E21B 47/14 |
| 2019/0112917 | A1 | 4/2019 | Disko et al. | E21B 47/14 |
| 2019/0112918 | A1 | 4/2019 | Yi et al. | E21B 4/16 |
| 2019/0112919 | A1 | 4/2019 | Song et al. | E21B 47/16 |
| 2019/0116085 | A1 | 4/2019 | Zhang et al. | H04L 12/24 |

FOREIGN PATENT DOCUMENTS

| | | | |
|---|---|---|---|
| EP | 1409839 | 4/2005 | E21B 43/1185 |
| EP | 2677698 | 12/2013 | H04L 12/28 |
| EP | 2763335 | 8/2014 | H04B 11/00 |
| GB | 2438481 | 3/2010 | |
| WO | WO2001/03391 | 1/2001 | H04B 11/00 |
| WO | WO2002/027139 | 4/2002 | E21B 43/12 |
| WO | WO2004/033852 | 4/2004 | |
| WO | WO2010/074766 | 7/2010 | A41C 1/14 |
| WO | WO2013/079928 | 6/2013 | E21B 47/12 |
| WO | WO2013/162506 | 10/2013 | |
| WO | WO2014/018010 | 1/2014 | E21B 47/12 |
| WO | WO2014/049360 | 4/2014 | E21B 47/12 |
| WO | WO2014/100271 | 6/2014 | E21B 47/12 |
| WO | WO2014/134741 | 9/2014 | E21B 47/13 |
| WO | WO2015/117060 | 8/2015 | E21B 47/12 |

OTHER PUBLICATIONS

U.S. Appl. No. 16/175,441, filed Oct. 30, 2018, Song, Limin et al.
U.S. Appl. No. 16/175,467, filed Oct. 30, 2018, Kinn, Timothy F et al.
U.S. Appl. No. 16/175,488, filed Oct. 30, 2018, Yi, Xiaohua et al.
U.S. Appl. No. 16/220,327, filed Dec. 14, 2018, Disko, Mark M. et al.
U.S. Appl. No. 16/220,332, filed Dec. 14, 2018, Yi, Xiaohua et al.
U.S. Appl. No. 16/269,083, filed Feb. 6, 2019, Zhang, Yibing.
U.S. Appl. No. 16/267,950, filed Feb. 5, 2019, Walker, Katie M et al.
U.S. Appl. No. 62/782,153, filed Dec. 19, 2019, Yi, Xiaohua et al.
U.S. Appl. No. 62/782,160, filed Dec. 19, 2018, Hall, Timothy J. et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.
Arroyo, Javier et al. (2011) "Forecasting with Interval and Histogram Data Some Financial Applications," *Univ. of California, Dept. of Economics*, 46 pages.
Emerson Process Management (2011), "Roxar downhole Wireless PT sensor system," www.roxar.com, or downhole@roxar.com, 2 pgs.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data In The Indirect Dimension", pp. 8888-8909.
U.S. Department of Defense (1999) "Interoperability and Performance Standards for Medium and High Frequency Radio Systems," *MIL-STD-188-141B*, Mar. 1, 1999, 584 pages.
U.S. Appl. No. 62/588,067, filed Nov. 17, 2017, Song, Limin et al.
U.S. Appl. No. 62/588,080, filed Nov. 17, 2017, Kinn, Timothy F et al.
U.S. Appl. No. 62/588,054, filed Nov. 17, 2017, Kent, David K et al.
U.S. Appl. No. 16/139,373, filed Sep. 24, 2018, Yi, Xiaohua et al.
U.S. Appl. No. 16/139,384, filed Sep. 24, 2018, Disko, Mark M et al.
U.S. Appl. No. 16/139,394, filed Sep. 24, 2018, Song, Limin et al.
U.S. Appl. No. 16/139,414, filed Sep. 24, 2018, Zhang, Yibing et al.
U.S. Appl. No. 16/139,421, filed Sep. 24, 2018, Song, Limin et al.
U.S. Appl. No. 16/139,427, filed Sep. 24, 2018, Disko, Mark M. et al.

* cited by examiner

500

600

METHOD AND SYSTEM FOR PERFORMING HYDROCARBON OPERATIONS USING COMMUNICATIONS ASSOCIATED WITH COMPLETIONS

CROSS REFERENCE TO RELATED APPLICATION

This application claims the priority benefit of U.S. Provisional Patent Application No. 62/588,103, filed Nov. 17, 2017 entitled "Method and System for Performing Hydrocarbon Operations using Communications Associated with Completions," the entirety of which is incorporated by reference herein.

This application is related to U.S. Publication No. 2018/0058207, published Mar. 1, 2018 entitled "Dual Transducer Communications Node for Downhole Acoustic Wireless Networks and Method Employing Same;" U.S. Publication No. 2018/0058206, published Mar. 1, 2018 entitled "Communication Networks, Relay Nodes for Communication Networks, and Methods of Transmitting Data Among a Plurality of Relay Nodes;" U.S. Publication No. 2018/0058208, published Mar. 1, 2018 entitled "Hybrid Downhole Acoustic Wireless Network;" U.S. Publication No. 2018/0058203, published Mar. 1, 2018 entitled "Methods of Acoustically Communicating and Wells that utilize the Methods," U.S. Publication No. 2018/0058209, published Mar. 1, 2018 entitled "Downhole Multiphase Flow Sensing Methods;" U.S. Publication No. 2018/0066510, published Mar. 8, 2018 entitled "Acoustic Housing for Tubulars," the disclosures of which are incorporated herein by reference in their entireties.

This application is related to U. S. Patent Applications having common inventors and assignee: U.S. application Ser. No. 16/139,414, filed Sep. 24, 2018 entitled "Method and System for Performing Operations using Communications;" U.S. patent application Ser. No. 16/139,394, filed Sep. 24, 2018 entitled "Method and System for Performing Communications using Aliasing;" U.S. patent application Ser. No. 16/139,427, filed Sep. 24, 2018 entitled "Method and System for Performing Operations with Communications;" U.S. patent application Ser. No. 16/139,421, filed Sep. 24, 2018 entitled "Method and System for Performing Wireless Ultrasonic Communications Along a Drilling String;" U.S. patent application Ser. No. 16/139,384, filed Sep. 24, 2018 entitled "Method and System for Performing Hydrocarbon Operations with Mixed Communication Networks;" U.S. Provisional Application No. 62/588,054, filed Nov. 17, 2017 entitled "Method and System for Performing Communications During Cementing Operations;" U.S. patent application Ser. No. 16/139,373, filed Sep. 24, 2018 entitled "Vertical Seismic Profiling;" U.S. Provisional Application No. 62/588,067, filed Nov. 17, 2017 entitled "Method and System for Performing Operations using Communications for a Hydrocarbon System;" U.S. Provisional Application No. 62/588,080, filed Nov. 17, 2017 entitled "Method and System for Performing Wireless Ultrasonic Communications Along Tubulars Members," the disclosures of which are incorporated herein by reference in their entireties.

FIELD OF THE INVENTION

This disclosure relates generally to the field of performing operations, such as hydrocarbon exploration, hydrocarbon development, and hydrocarbon production and, more particularly, to communicating and obtaining measurement data. Specifically, the disclosure relates to methods and systems for communicating with communication nodes, which may include being disposing along one or more tubular members, such as along casing or tubing within a wellbore, and utilized to enhance gravel packing and other associated operations.

BACKGROUND

This section is intended to introduce various aspects of the art, which may be associated with exemplary embodiments of the present disclosure. This discussion is believed to assist in providing a framework to facilitate a better understanding of particular aspects of the present invention. Accordingly, it should be understood that this section should be read in this light, and not necessarily as admissions of prior art.

In hydrocarbon exploration, hydrocarbon development, and/or hydrocarbon production operations, several real time data systems or methods have been proposed. As a first example, a physical connection, such as a cable, an electrical conductor or a fiber optic cable, is secured to a tubular member, which may be used to evaluate conditions, such as subsurface conditions. The cable may be secured to an inner portion of the tubular member or an outer portion of the tubular member. The cable provides a hard wire connection to provide real-time transmission of data. Further, the cables may be used to provide high data transmission rates and the delivery of electrical power directly to downhole sensors. However, use of physical cables may be difficult as the cables have to be unspooled and attached to the tubular member sections disposed within a wellbore. Accordingly, the conduits being installed into the well may not be rotated because of the attached cables, which may be broken through such installations. This limitation may be problematic for installations into horizontal wells, which typically involve rotating the tubular members. These passages for the cables provide potential locations for leakage of fluids, which may be more problematic for configurations that involve high pressures fluids. In addition, the leakage of down-hole fluids may increase the risk of cement seal failures.

In contrast to physical connection configurations, various wireless technologies may be used for downhole communications. Such technologies are referred to as telemetry. These communication nodes communicate with each other to manage the exchange of data within the wellbore and with a computer system that is utilized to manage the hydrocarbon operations. The communication nodes may involve different wireless network types. As a first example, radio transmissions may be used for wellbore communications. However, the use of radio transmissions may be impractical or unavailable in certain environments or during certain operations, such as gravel packing. Acoustic telemetry utilizes an acoustic wireless network to wirelessly transmit an acoustic signal, such as a vibration, via a tone transmission medium. In general, a given tone transmission medium may only permit communication within a certain frequency range; and, in some systems, this frequency range may be relatively small. Such systems may be referred to herein as spectrum-constrained systems. An example of a spectrum-constrained system is a well, such as a hydrocarbon well, that includes a plurality of communication nodes spaced-apart along a length thereof. However, conventional data transmission mechanisms may not be effectively utilized and may not be utilized with certain hydrocarbon operations.

By way of example, sand production may have multiple adverse effects in hydrocarbon operations. As wellbores are drilled to provide access to subsurface fluids, the produced fluids may include sand or other solids along with the hydrocarbons and/or water. Sand production may increase significantly during the first flow and/or water breakthrough. Unfortunately, the sand production may reduce well productivity, may damage completion devices, may hinder wellbore access and/or may increase solid disposal.

To limit sand production, various completion options may be used to limit sand production. These completion options may include gravel packing and/or resin injection. Gravel packing involves running sand screens into the wellbore and disposing gravel around the exterior surface of the sand screens. Because voids or gaps may form in the gravel pack, the voids or gaps may lead to early completion failure or sand production increases. To monitor the formed gravel pack, conventional approaches utilize wireline or logging tools that may be used to evaluate the gravel pack conditions, such as nuclear density logging, neutron activation logging or isotope logging. However, such conventional approaches are wired systems and require extra rig time to deploy the wired monitoring tool into and then out of the wellbore. As a result, the conventional approaches are time consuming, increase expenses associated with the hydrocarbon operations.

Accordingly, there remains a need in the industry for methods and systems that are more efficient and may lessen problems associated with noisy and ineffective communication. Further, a need remains for efficient approaches to perform real-time or concurrent monitoring during the gravel packing operations, which involves acoustic communicating along tubular members within a wellbore. The present techniques provide methods and systems that overcome one or more of the deficiencies discussed above.

SUMMARY

In one embodiment, a method of communicating data among a plurality of communication nodes is described. The method comprises: obtaining well data for a subsurface region; determining a communication network based on the obtained well data, wherein the communication network includes a plurality of communication nodes; installing the plurality of communication nodes into the wellbore and a gravel pack system, wherein one or more communication nodes of the plurality of communication nodes are configured to obtain measurements associated with a gravel pack location and to transmit the measurement data to other communication nodes in the communication network, and wherein the gravel pack system is disposed at the gravel pack location; performing gravel pack operations to install a gravel pack at the gravel pack location, wherein the performing gravel pack operations include: obtaining measurements near the gravel pack location with one of the one or more communication nodes during the gravel pack operations; and transmitting data packets associated with the obtained measurements from the one of the one or more communication nodes to a control unit via the communication network during the gravel pack operations; and performing hydrocarbon operations in the wellbore.

The method may include one or more enhancements. The method may further comprise adjusting gravel pack operations based on the transmitted data packets associated with the obtained measurements; further comprising determining voids or gaps in the gravel pack during the gravel pack operations; further comprising identifying one or more properties and the gravel pack location for the gravel pack installation; further comprising configuring the plurality of the communication nodes based on a communication network configuration; wherein the communication network configuration comprises selecting one of one or more frequency bands, one or more individual tones, one or more coding methods, and any combination thereof; further comprising producing hydrocarbons from the wellbore through the gravel pack; wherein the transmitting data packets comprises transmitting high-frequency signals that are greater than (>) 20 kilohertz; wherein the transmitting data packets comprises transmitting high-frequency signals that are in the range between greater than 20 kilohertz and 1 megahertz; wherein the performing gravel pack operations comprise: providing the gravel pack system that includes one or more sand screens, passing a carrier fluid into the wellbore, disposing the gravel or the gravel pack proppants adjacent to one or more sand screens to form the gravel pack, and conducting away a remaining portion of the carrier fluid through the one or more sand screens; further comprising: conditioning drilling fluid to remove solid particles from the drilling fluid, and combining the gravel or gravel pack propellants with the conditioned drilling fluid, wherein the conditioned drilling fluid is one of a solids-laden oil-based fluid, a solids-laden non-aqueous fluid, and a solids-laden water-based fluid; further comprising: obtaining measurements near the gravel pack location with one of the one or more communication nodes during the hydrocarbon operations, and transmitting data packets associated with the obtained measurements from the one of the one or more communication nodes to the control unit via the communication network during the hydrocarbon operations; further comprising determining flux near the gravel pack location with one of the one or more communication nodes based on the measured data; further comprising determining fluid composition near the gravel pack location with one of the one or more communication nodes based on the measured data; and/or further comprising determining pressure near the gravel pack location with one of the one or more communication nodes based on the measured data.

A hydrocarbon system is described. The hydrocarbon system comprises: a wellbore in a hydrocarbon system; a plurality of tubular members disposed in the wellbore; a communication network associated with the hydrocarbon system, wherein the communication network comprises a plurality of communication nodes that are configured to communicate operational data between two or more of the plurality of communication nodes during hydrocarbon operations; and a gravel pack monitoring system, wherein one or more communication nodes of the plurality of communication nodes are configured to obtain measurements near the gravel pack location and to transmit the measurement data to other communication nodes in the communication network.

The system may include one or more enhancements. The system may include wherein the one or more communication nodes of the plurality of communication nodes are configured to measure changes in pressure of fluids adjacent to the one or more communication nodes during the cementing installation operations; wherein the one or more communication nodes of the plurality of communication nodes are configured to measure changes in flux in a portion of the gravel pack; wherein the plurality of communication nodes are configured to transmit high-frequency signals that are greater than (>) 20 kilohertz; wherein the plurality of communication nodes are configured to transmit high-frequency signals that are in the range between greater than 20 kilohertz and 1 megahertz.

BRIEF DESCRIPTION OF THE DRAWINGS

The advantages of the present invention are better understood by referring to the following detailed description and the attached drawings.

0

DETAILED DESCRIPTION

Figure 1:
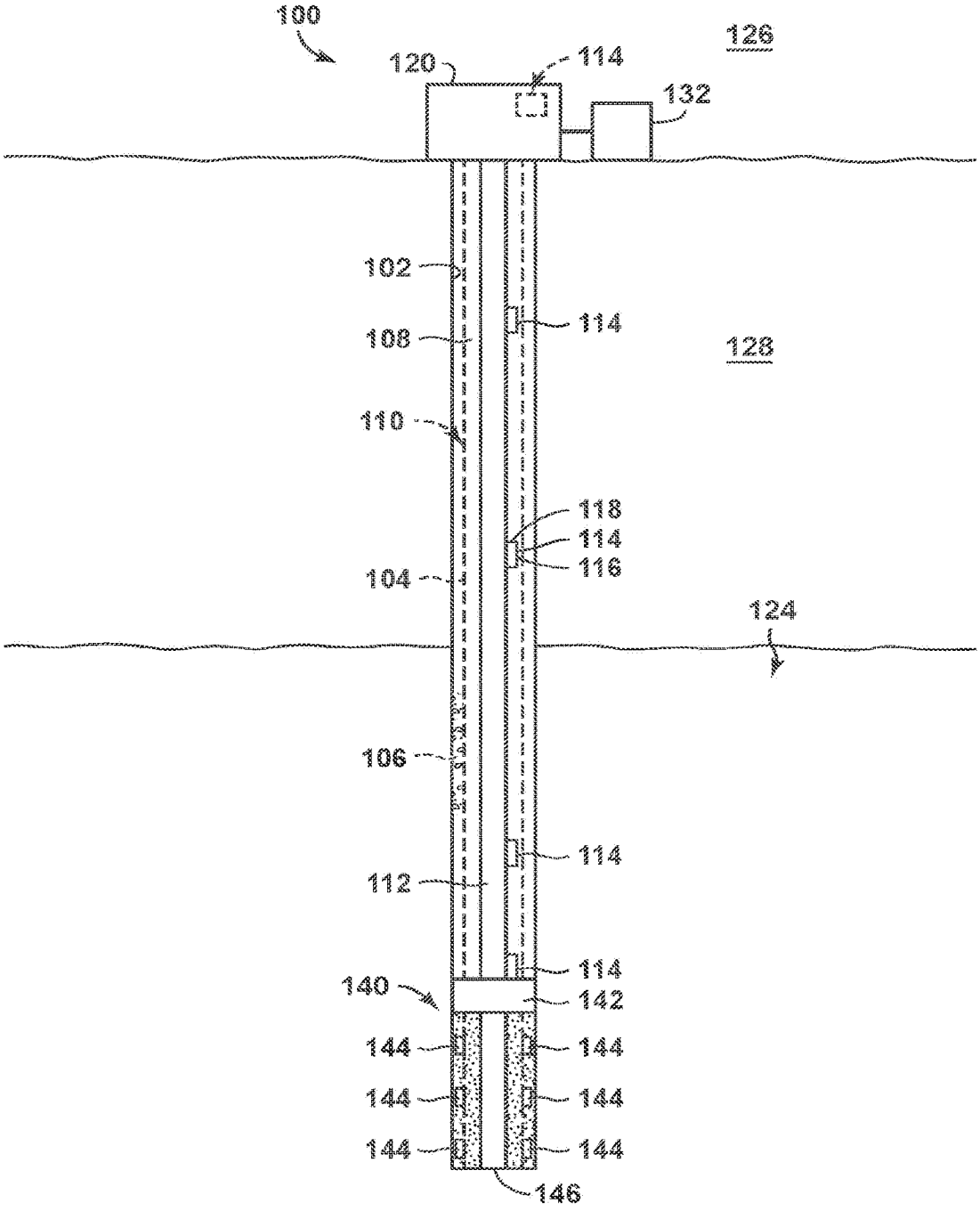
FIG. 1 is an exemplary schematic representation of a well configured to utilize a communication network having a gravel pack monitoring system that includes one or more communication nodes in accordance with certain aspects of the present techniques.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

The articles "the", "a", and "an" are not necessarily limited to mean only one, but rather are inclusive and open ended so as to include, optionally, multiple such elements.

The directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

As used herein, the term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of".

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "any" means one, some, or all indiscriminately of whatever quantity.

As used herein, "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

As used herein, "based on" does not mean "based only on", unless expressly specified otherwise. In other words, the phrase "based on" describes both "based only on," "based at least on," and "based at least in part on."

As used herein, "clock tick" refers to a fundamental unit of time in a digital processor. For example, one clock tick equals the inverse of the effective clock speed that governs operation of the processor. Specifically, one clock tick for a 1 MHz effective clock speed is equal to one microsecond. As another example, one clock tick may be equivalent to the minimum amount of time involved for a scalar processor to execute one instruction. A processor may operate at various effective clock speeds, and, as such, the amount of time equivalent to one clock tick may vary, but a fractional clock tick is not possible.

As used herein, "conduit" refers to a tubular member forming a physical channel through which something is conveyed. The conduit may include one or more of a pipe, a manifold, a tube or the like, or the liquid contained in the tubular member. Alternately, conduit refers to an acoustic channel of liquid which may, for example, exist between the formation and a tubular.

As used herein, "couple" refers to an interaction between elements and is not meant to limit the interaction to direct interaction between the elements and may also include indirect interaction between the elements described. Couple may include other terms, such as "connect", "engage", "attach", or any other suitable terms.

As used herein, "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

As used herein, "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

As used herein, "exemplary" is used exclusively herein to mean "serving as an example, instance, or illustration." Any embodiment described herein as "exemplary" is not necessarily to be construed as preferred or advantageous over other embodiments.

As used herein, "formation" refers to any definable subsurface region. The formation may contain one or more hydrocarbon-containing layers, one or more non-hydrocarbon containing layers, an overburden, and/or an underburden of any geologic formation.

As used herein, "hydrocarbons" are generally defined as molecules formed primarily of carbon and hydrogen atoms such as oil and natural gas. Hydrocarbons may also include other elements or compounds, such as, but not limited to, halogens, metallic elements, nitrogen, oxygen, sulfur, hydrogen sulfide ($H_2S$), and carbon dioxide ($CO_2$). Hydrocarbons may be produced from hydrocarbon reservoirs through wells penetrating a hydrocarbon containing formation. Hydrocarbons derived from a hydrocarbon reservoir may include, but are not limited to, petroleum, kerogen, bitumen, pyrobitumen, asphaltenes, tars, oils, natural gas, or combinations thereof. Hydrocarbons may be located within or adjacent to mineral matrices within the earth, termed reservoirs. Matrices may include, but are not limited to, sedimentary rock, sands, silicilytes, carbonates, diatomites, and other porous media.

As used herein, "hydrocarbon exploration" refers to any activity associated with determining the location of hydrocarbons in subsurface regions. Hydrocarbon exploration normally refers to any activity conducted to obtain measurements through acquisition of measured data associated with the subsurface formation and the associated modeling of the data to identify potential locations of hydrocarbon accumulations. Accordingly, hydrocarbon exploration includes acquiring measurement data, modeling of the measurement data to form subsurface models, and determining the likely locations for hydrocarbon reservoirs within the subsurface. The measurement data may include seismic data, gravity data, magnetic data, electromagnetic data, and the like. The hydrocarbon exploration activities may include drilling exploratory wells.

As used herein, "hydrocarbon development" refers to any activity associated with planning of extraction and/or access to hydrocarbons in subsurface regions. Hydrocarbon development normally refers to any activity conducted to plan for access to and/or for production of hydrocarbons from the subsurface formation and the associated modeling of the data to identify preferred development approaches and methods. By way of example, hydrocarbon development may include modeling of the subsurface formation and extraction planning for periods of production, determining and planning equipment to be utilized and techniques to be utilized in extracting the hydrocarbons from the subsurface formation, and the like.

As used herein, "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° Celsius (C) and 1 atmospheric (atm) pressure). Hydrocarbon fluids may include, for example, oil, natural gas, gas condensates, coal bed methane, shale oil, shale gas, and other hydrocarbons that are in a gaseous or liquid state.

As used herein, "hydrocarbon operations" refers to any activity associated with hydrocarbon exploration, hydrocarbon development, collection of wellbore data, and/or hydrocarbon production. It may also include the midstream pipelines and storage tanks, or the downstream refinery and distribution operations. By way of example, the hydrocarbon operations may include managing the communications for the wellbore through the communication nodes by utilizing the tubular members, such as drilling string and/or casing.

As used herein, "hydrocarbon production" refers to any activity associated with extracting hydrocarbons from subsurface location, such as a well or other opening. Hydrocarbon production normally refers to any activity conducted to form the wellbore along with any activity in or on the well after the well is completed. Accordingly, hydrocarbon production or extraction includes not only primary hydrocarbon extraction, but also secondary and tertiary production techniques, such as injection of gas or liquid for increasing drive pressure, mobilizing the hydrocarbon or treating by, for example, chemicals, hydraulic fracturing the wellbore to promote increased flow, well servicing, well logging, and other well and wellbore treatments.

As used herein, "mode" refers to a setting or configuration associated with the operation of communication nodes in a communication network. For example, the mode may include a setting for acoustical compression wave, acoustical shear wave, or any combination thereof.

As used herein, "monitored section" and "monitored sections" refer to locations along the tubular members that include sensors and/or are regions of interest.

As used herein, "unmonitored section" and "unmonitored sections" refer to locations along the tubular members that do not include sensors and/or are not regions of interest.

As used herein, "operatively connected" and/or "operatively coupled" means directly or indirectly connected for transmitting or conducting information, force, energy, or matter.

As used herein, "optimal", "optimizing", "optimize", "optimality", "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

As used herein, "potting" refers to the encapsulation of electrical components with epoxy, elastomeric, silicone, or asphaltic or similar compounds for the purpose of excluding moisture or vapors. Potted components may or may not be hermetically sealed.

As used herein, "range" or "ranges", such as concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, "sealing material" refers to any material that can seal a cover of a housing to a body of a housing sufficient to withstand one or more downhole conditions including but not limited to, for example, temperature, humidity, soil composition, corrosive elements, pH, and pressure.

As used herein, "sensor" includes any electrical sensing device or gauge. The sensor may be capable of monitoring or detecting density, pressure, temperature, gamma ray, stress, strain, fluid flow, vibration, resistivity, or other formation data. Alternatively, the sensor may be a position sensor.

As used herein, "stream" refers to fluid (e.g., solids, liquid and/or gas) being conducted through various regions, such as equipment and/or a formation. The equipment may include conduits, vessels, manifolds, units or other suitable devices.

As used herein, "subsurface" refers to geologic strata occurring below the earth's surface.

As used herein, "telemetry diagnostic data", "diagnostic telemetry data", or "telemetry data" refer to data associated with the communication nodes exchanging information. The telemetry data may be exchanged for the purpose of assessing and proving or otherwise optimizing the communication. By example, this may include frequency and/or amplitude information.

As used herein, "physical layer" refers to the lowest layer of the Open Systems Interconnection model (OSI model) maintained by the identification ISO/IEC 7498-1. The OSI model is a conceptual model that partitions a communication system into abstraction layers. The physical layer defines basic electrical and physical specifications of the network such as acoustic frequency band, radio-frequency (RF) frequency band, acoustic versus electromagnetic communication, and other electrical and physical aspects of the communication.

As used herein, "direct mapping" refers to establishing a correspondence between communication frequencies and symbolic information such that particular communication frequencies represent a particular piece of symbolic information. Examples of symbolic information include, but are not limited to, the letters in alphabet or specific arrangements of bits in a computer memory. By way of example, direct mapping in an acoustic telemetry system may include each 100 kHz tone representing the letter "A", each 102 kHz tone representing the letter "B", each 104 kHz tone representing the letter "C", and so on. By contrast, "spread spectrum" may involve a correspondence between communication frequencies and symbolic information that changes repeatedly and in rapid fashion, such that, by way of example, a 100 kHz tone may represent the letter "A" and a 104 kHz tone may represent the letter "B" and a 102 kHz tone may represent the letter "C", then a 110 kHz tone may represent the letter "A" and a 112 kHz tone may represent the letter "B" and a 114 kHz tone may represent the letter "C", then a 90 kHz tone may represent the letter "A" and a 84 kHz tone may represent the letter "B" and a 96 kHz tone may represent the letter "C", and so on. In addition, the direct mapping may not change, while spread spectrum may change.

As used herein, "frequency combining" refers to aggregating similar frequencies by dividing the range of possible frequencies into a number of sections and classifying all frequencies within any one section as occurrences of a single frequency. It will be apparent to a person skilled in the computational arts that the totality of possible frequencies may be excessively large, leading to an excessive degree of computational complexity inherent in analysis of the frequencies, and that frequency combining can limit the number of possibilities to reduce the computational complexity inherent in analysis of the possibilities to an acceptable level. The limited number of possibilities resulting from frequency combining may be referred to as the "combined frequencies". The cadence of digital clock ticks acts as an upper bound on the number of possible combined frequencies in all cases.

As used herein, "signal strength" refers to a quantitative assessment of the suitability of a characteristic for a particular purpose. A characteristic may be an amplitude, a Fast Fourier Transform (FFT) magnitude, a signal-to-noise ratio (SNR), a zero crossing (ZCX) quality, a histogram quantity, an occurrence count, a margin or proportion above a baseline, or any other suitable measurement or calculation. By way of example, a histogram representing ZCX occurrence counts by period may assess ZCX signal strength for each period by dividing the occurrence count for each period by the maximum occurrence count in the histogram such that the ZCX signal strength for the period having the maximum occurrence count is 1 and this is the highest ZCX signal strength among all the periods in the histogram.

As used herein, "tubular member", "tubular section" or "tubular body" refer to any pipe, such as a joint of casing, a portion of a liner, a drill string, a production tubing, an injection tubing, a pup joint, a buried pipeline, underwater piping, or above-ground piping. Solid lines therein, and any suitable number of such structures and/or features may be omitted from a given embodiment without departing from the scope of the present disclosure.

As used herein, "wellbore" or "downhole" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

As used herein, "well data" may include seismic data, electromagnetic data, resistivity data, gravity data, well log data, core sample data, and combinations thereof. The well data may be obtained from memory or from the equipment in the wellbore. The well data may also include the data associated with the equipment installed within the wellbore and the configuration of the wellbore equipment. For example, the well data may include the composition of the tubular members, thickness of the tubular members, length of the tubular members, fluid composition within the wellbore, formation properties, cementation within the wellbore and/or other suitable properties associated with the wellbore.

As used herein, "zone", "region", "container", or "compartment" is a defined space, area, or volume contained in the framework or model, which may be bounded by one or more objects or a polygon encompassing an area or volume of interest. The volume may include similar properties.

The exchange of information may be used to manage the operations for different technologies. By way of example, the communication network may include communication nodes disposed along one or more tubular members. The communication nodes may be distributed along casing or tubing within a wellbore, along a subsea conduit and/or along a pipeline, to enhance associated operations. To exchange information, the communication network may include physically connected communication nodes, wirelessly connected communication nodes or a combination of physically connected communication nodes and wirelessly connected communication nodes.

By way of example, the communication network may be used for data exchanges of operational data, which may be used for real-time or concurrent operations involving hydrocarbon exploration operations, hydrocarbon development operations, and/or hydrocarbon production operations, for example. In hydrocarbon operations, the system or method may involve communicating via a downhole network including various communication nodes spaced-apart along a length of tubular members, which may be a tone transmission medium (e.g., conduits). In addition, certain communication nodes near specific tools or near certain regions may include one or more sensors. The communication nodes may communicate with each other to manage the exchange of data within the wellbore and with a computer system that is utilized to manage the hydrocarbon operations. By way of example, the communication network may involve transmitting and/or receiving signals or tones via one or more frequencies of acoustic tones in the form of data packets via the tone transmission medium. The downhole wireless communication through the tubular members, such as casing and/or production tubing, may be beneficial for enhancing hydrocarbon operations, such as monitoring and/or optimizing the formation of gravel packs, managing the operation of the completions, and/or monitoring the operation of the well once the gravel pack is installed. In such communications, the communication network may include communication nodes, which may include one or more sensors or sensing components, that utilize ultrasonic acoustic frequencies to exchange information, which may simultaneously or concurrently performed with the gravel pack operations. The sensing components may be used to detect voids and/or hot spots, which may indicate locations that the sand screen may fail. The higher flux locations may be measured from flow rate over area and may involve a dense configuration of sensors.

In certain configurations, the communication nodes may include a housing that isolates various components from the wellbore environment. In particular, the communication nodes may include one or more encoding components, which may be configured to generate and/or to induce one or more acoustic tones within tone transmission medium, such as a tubular member or liquid inside the tubular member. Alternately, conduit refers to an acoustic channel of liquid which may, for example, exist between the formation and a tubular member. In addition, the communication nodes may include one or more decoding components, which may be configured to receive and/or to decode acoustic tones from the tone transmission medium. The communication nodes may include one or more power supplies configured to supply energy to the other components, such as batteries. The communication nodes may include one or more sensors, which may be configured to obtain measurement data associated with the downhole environment and/or the formation. In particular, the one or more sensors may be used to monitor the formation of the gravel pack, and/or the composition of the fluids. The communication nodes may include relatively small transducers to lessen the size of the communication nodes, such that they may be disposed or secured to locations having limited clearance, such as between successive layers of downhole tubular members, such as sand screens. As an example, small acoustic transducers may be configured to transmit and/or receive tones.

As noted above, sand production has multiple adverse effects to hydrocarbon operations, such as reducing well productivity, damaging completion devices and/or posing difficulties of wellbore access and solid disposal. As voids or gaps may be formed in gravel packs, monitoring the gravel pack installation may be utilized to enhance gravel pack operations. In contrast to logging tools (e.g., nuclear density logging, neutron activation logging or isotope logging) that are used to evaluate gravel pack formations, the present techniques utilize communication nodes to provide real-time or concurrent data associated with the formation of the gravel pack and may also be used to monitor the operation of the materials being produced from the subsurface region near the associated sand screen. Beneficially, the use of the communication nodes for monitoring the formation of the gravel pack does not utilize a wired systems that involves extra rig time to run the logging tool into the wellbore and out of the wellbore. Accordingly, the present techniques provide a concurrent or real-time gravel pack evaluation system to monitor the formation of the gravel pack conditions during installation and long term performance during production.

In certain configurations, the present techniques may include system setup. The communication nodes may include one or more ultrasonic transducers for transmitting and receiving acoustic signals; electronic circuits for signal processing and computation; and/or batteries for power supply. Extra ultrasonic transducers with same or different operating frequencies may be included for sensing purposes. The communication nodes may include one or more sensing components installed on tubular member (e.g., casing and/or tubing, such as a sand screen). The one or more sensing components may form a sensor array for data collection as well as communication. The measured data may be relayed back to topside equipment to a control unit. As gravel pack locations are predefined (e.g., monitored sections), one or more dedicated sensors may be installed along tubular members in the preferred configurations to monitor the gravel pack locations (e.g., distribution of communication nodes with sensors or distribution of a communication node with associated sensors). For other areas of the wellbore (e.g., unmonitored sections), the communication nodes are primarily used for data packet exchanges, which are used to relay the measured data to a control unit at the topside for surveillance.

To determine voids or gaps in the gravel pack area, the system may include one or more sensors in a dense configuration in the gravel pack area. The sensors may be configured to measure pressure, temperature, gamma ray, flow meter, resistivity, capacitance, stress, strain, density, vibration and any combination thereof. The sensors may be within the housing of the communication node or may include individual housings for the sensors and a controller that houses the other components. The distributed sensors provide localized measurement data about the existence of voids and/or gaps in the gravel pack. The data may be combined, integrated and used to generate a 3D gravel pack map associated with the gravel pack in the monitored region. As a result, the acoustic attenuation between two sensors may also provide an indication of installation indicator (e.g., quality indicator) for qualitative check. The communication node may be configured to perform calculations to determine the flux, fluid flow, fluid composition and/or properties prior to transmitting the data packets or signals between the communication nodes and/or the control unit.

In certain configurations, the gravel pack monitoring system is pre-installed on the tubular member (e.g., sand screen) prior to disposing the gravel pack system into the wellbore. In such as configuration, the gravel pack monitoring system may be disposed at the gravel packing area to monitor before the gravel packing is provided to the area, during the gravel packing installation, and even after the gravel packing is installed. The monitoring may include measuring a first property for the gravel pack operations before the gravel packing installation and during the gravel packing operations and then may include measuring a second property for the gravel pack operations after the gravel packing installation. The measurements may be transmitted to the control unit or a processor in the communication node, which may be configured to compare the measurements for different time periods to determine information about the progress of the gravel pack installation. The comparisons may be used to determine if the gravel pack operations should be adjusted based on the measurement data.

In certain configurations, the gravel pack monitoring system may include one or more communication nodes, which may include various sensors, configured to exchange data packets with a control unit. The communication nodes may be disposed on an interior surface of the sand screen, an external surface of the sand screen, and/or a combination thereof. In the communication nodes include one or more sensors, the sensors may be distributed in individual housings that communicate with a controller and/or a single housing. The sensors may be disposed on an interior surface of the sand screen, an external surface of the sand screen, and/or a combination thereof. The sensors may be used to acquire measurements associated with the area that the gravel pack is to be installed, about the gravel pack installation, and/or about the environment or fluids after the gravel pack is installed. The exchange of data with the control unit from the communication nodes may be performed in real time or concurrently with the gravel pack operations (e.g., exchanging of fluids near the gravel pack area, disposing gravel into the gravel pack area, and/or removing carrier fluid after installation of the gravel pack).

The communication nodes may be configured to perform ultrasonic telemetry and sensing in specific frequency bands. As an example, the communication network may utilize low-frequency ranges and/or high-frequency ranges (e.g., may include low-frequency communication nodes and/or high-frequency communication nodes). The low-frequency communication nodes may be configured to transmit signals and to receive signals that are less than or equal to (≤) 200 kHz, ≤100 kHz, ≤50 kHz, or ≤20 kHz. In particular, the low-frequency communication nodes may be configured to exchange signals in the range between 100 Hz and 20 kHz; in the range between 1 kHz and 20 kHz; and in the range between 5 kHz and 20 kHz.

Other configurations may include low-frequency communication nodes, which may be configured to exchange signals in the range between 100 Hz and 200 kHz; in the range between 100 Hz and 100 kHz; in the range between 1 kHz and 200 kHz; in the range between 1 kHz and 100 kHz; in the range between 5 kHz and 100 kHz and in the range between 5 kHz and 200 kHz. The communication nodes may also include high-frequency communication nodes configured to transmit and receive signals that are greater than (>) 20 kHz, >50 kHz, >100 kHz or >200 kHz. Also, the high-frequency communication nodes may be configured to exchange signals in the range between greater than 20 kHz and 1 MHz, in the range between greater than 20 kHz and 750 kHz, in the range between greater than 20 kHz and 500 kHz. Other configurations may include high-frequency communication nodes, which may be configured to exchange signals in the range between greater than 100 kHz and 1 MHz; in the range between greater than 200 kHz and 1 MHz; in the range between greater than 100 kHz and 750 kHz; in the range between greater than 200 kHz and 750 kHz; in the range between greater than 100 kHz and 500 kHz; and in the range between greater than 200 kHz and 500 kHz.

In addition, the communication nodes may operate with low frequency bands and/or high-frequency bands to enhance operations. The communication nodes may include piezo transducers that may be coupled to the environment to be sensed (e.g., pulse echo from piezo assembly behind a thin steel wall and thus proximate flowing media, hydrates, sand, which may be within the tubular member and/or external to the tubular member). The configurations may include the use of acoustic or other transducer arrays spaced on an azimuth. Such transducer arrays may be used to launch single mode acoustic or vibrational waves that may be tailored for one or more of: (i) long distance telemetry, (ii) focusing the acoustic energy in steel tubular, or within media, or outside of surface of tubular, (iii) for one or more piezoelectric transducers, the termination properties, coupling to adjoining tubular members, and preferable acoustic wave properties that may be enhanced by the radial design versus a point or wide line attachment.

In still yet another configuration, the electronic circuits are present within the communication nodes (e.g., which may include sensors) to process the collected measurement data, store the data for transmission, and conduct necessary on-board computation to simplify data for transmission. Local detection of faulty data, data compression, and automated communication with neighboring sensors may be performed with the on-board electronics, signal processing components and microprocessor. In such a configuration, the communication nodes of the gravel pack monitoring system may efficiently manage the exchange of measured data, which may be communicated in real time or concurrently with the installation of the gravel pack within the subsurface region.

In another configuration, the communication node may be configured to function as a transmitter and/or receiver for data transmission to the control unit disposed at the topside or other devices within the wellbore. In other configurations, multiple different types of devices may be connected. For example, if it is an acoustic system, piezos may be facilitated as a transmitter and a receiver to relay data back to topside equipment or other communication nodes. If it is an electromagnetic system, then radio-frequency receivers with communication frequency ranges may be integrated.

In other configurations, the communication nodes may be configured to function as a transmitter and/or receiver and/or may be oriented to receive and/or transmit inside the tubular member, outside the tubular member and/or a combination thereof. The range of the communication nodes may be extended by broadcasting directly into the tubular member versus receiving and transmitting on the exterior of the tubular member. In addition, the reliability and quality of the acoustic transmission when broadcasting into the tubular member may be enhanced.

In addition, other configurations may include communications nodes and associated sensors integrated into an array, such as a collar and/or even within the sand screen. Such an integration may save time by avoiding an added step of clamping the communication nodes onto the tubular members prior to installation. This integration may include enhancing reliability by eliminating the field installation and potential of improper or poor mating of the communication nodes to the tubular member. The integration may avoid cost and/or the complexity of external communication nodes, which may be necessary for measure of pressure directly in flow zone or annulus. Telemetry electronics and/or hardware along with sensors in an integrated package that may maintain communication node physical integrity, while enhancing accuracy of in-flow zone measurements and/or exterior materials.

In addition to the variations on the configurations, the communication node may include different types of sensors, such as sonic logging components and/or an imaging measurement components. In such configurations, the communication nodes may include additional power supplies, such as batteries, to drive an array of acoustic sources or a single acoustic source to generate sufficient acoustic energy to perform sonic logging or obtaining imaging measurements, where the source may be triggered by a communication node. By way of example, the communication nodes may include one or more sensors may include a sonic log component. The sonic log component may operate by emitting a large acoustic pulse on the communication node, which is disposed near the sand screen. The sonic logging techniques may include an acoustic wave that may travel along the sand screen, along with any associated gravel pack, and any associated formation, with sufficient energy to be detected by the communication nodes. Using sonic logging interpretation techniques, the measured data may be used to evaluate voids or gaps (e.g., permeability, porosity, lithology, or fluid type in the nearby formation), and/or to evaluate the gravel pack before and after the gravel pack operations. Assessing some of these properties may involve additional data or knowledge of the system (e.g., well data).

To manage the transmission and reception of signals, the processor in the communication node may operate at one or more effective clock speeds. The presence of a clock in a digital system, such as a communication node, results in discrete (not continuous) sampling, and is frequency combining (e.g., any frequency that falls between clock ticks is detected at the higher tick or lower tick (because fractional ticks are not permitted), so in a sense, the frequencies that fall between clock ticks result in combined frequencies. The communication nodes may operate at a high-frequency effective clock speed and/or a low-frequency effective clock speed. The effective clock speed is the clock speed at which the processor operates after inclusion of applicable clock multipliers or clock dividers. As a result, the sampling frequency is equal to the effective clock speed, while the telemetry frequency is the frequency of a given telemetry tone. By way of example, the telemetry frequency may be less than or equal to 200 kHz, less than or equal to 150 kHz, less than or equal to 75 kHz or less than or equal to 50 kHz, or even the range may be between greater than 20 kHz and 1 MHz, in the range between greater than 20 kHz and 750 kHz, in the range between greater than 20 kHz and 500 kHz. The high-frequency effective clock speed may be may be greater than 200 kHz, greater than or equal to 500 kHz, greater than or equal to 1 MHz, greater than or equal to 10 MHz or greater than or equal to 100 MHz.

Downhole communications along the tubular members, such as casing and/or production tubing, may be beneficial for enhancing hydrocarbon operations, such as optimizing or monitoring gravel pack operations and monitoring the production of fluids after the gravel pack installation for well management. The present techniques may include various enhancements, such as frequency selection, which may utilize laboratory and/or surface testing facilities and acoustic waveguide theory. Another enhancement may include frequency optimization, which involves broadcast broadband signals locally between downhole neighboring communication nodes. For the frequency optimization, only the strongest acoustic signals may be selected and may be used for communication between each pair of communication nodes. Also, acoustic signals may be the same or different among different pairs of communication nodes in the system. As yet another enhancement, adaptive coding methods may be selected to support communication based on the selected number of acoustic frequencies. For one example, the communication may be successful when the right coding method is selected if the number of acoustic frequencies is limited (e.g., one frequency). However, the communication data rate may be compromised once the number of acoustic frequencies becomes limited. Further, the set of acoustic frequencies and coding method may also be re-evaluated and updated at various time intervals and/or as acoustic condition changes.

The communication network may include different types of wireless communication nodes that form respective wireless communication networks. The wireless networks may include long-range communication nodes (e.g., having a range between about 1 foot to about 1,000 feet, in a range between about 100 feet to 500 feet or even up to 1,000 feet). The long-range communication nodes may be formed into communication networks (e.g., an ultrasonic acoustic communication network) that may involve using a multiple frequency shift keying (MFSK) communication configuration. In MFSK communication configurations, reliable detection and decoding of the acoustic signal frequencies is the basis for this type of communication. As noted above, the unknown and unpredictable downhole acoustic conditions may be defined from the formation, cementation, and/or composition (e.g., gas, water and/or oil). Accordingly, it may be difficult to select the frequencies for acoustic signals to be utilized between the communication nodes prior to deployment within the wellbore to support a desired communication (e.g., long range communication) with minimum power consumption.

As another enhancement, the frequency ranges utilized for the communication network may be adjusted dynamically. In particular, the acoustic communication channel between each pair of communication nodes may be variable over a small frequency range. The frequency selectivity is a result of the coupling of acoustic signals to the tubular members from individual communication nodes, which may be influenced by the installation, but also may be influenced by conditions, such as the acoustic signal propagation path variations along the wellbore (e.g., formation, cement, casing, and/or composition of gas, water, and oil). As a further influence, the coupling and propagation of an acoustic signal may be disrupted after performing hydrocarbon operations (e.g., gravel packing operations in the wells). As a result, selecting one pre-selected set of acoustic frequencies for the entire communication system operational life is likely to be limiting.

By selecting and optimizing the acoustic frequencies in combination with adaptive coding methods between each pair of communication nodes, the present techniques provide a system and method to support reliable long range communication along tubular members, such as in the downhole environment. The frequency band selection method for communication networks may utilize laboratory and/or surface testing facilities and acoustic waveguide theory. Then, if needed, the individual acoustic frequencies may be further optimized after the communication nodes are deployed along the tubular members, such as once disposed into the wellbore. The acoustic signals with the highest signal strength in a broad frequency band are selected and used for communication between each pair of communication nodes, and they may be the same or different among different pairs of communication nodes in the system. After the frequencies are selected, one of several coding methods may be selected and adapted to support communication based on the selected number of acoustic frequencies. Within a specific time and/or condition changes, the set of acoustic frequencies and coding methods may be re-evaluated and updated to re-optimize system's communication reliability and speed.

Further, the acoustic communication band optimization may also include selecting a tone detection method. The tone detection method may include a fast Fourier transform (FFT), zero crossing (ZCX) and any combination thereof. The tones may be defined as decoded or detected if FFT recognizes the correct frequencies or ZCX recognizes the correct periods. The FFT and/or ZCX may be selected depending on computational power and energy efficiency of the microcontroller deployed in the communication node. For FFT, tone selection may be based on the relative magnitude of each tone. FFT may involve greater computational power, but is more able to handle background noise. For ZCX, tone selection may be based on normalized period of zero crossings of each tone. ZCX may involve less computational power, but may be vulnerable to misdetections due to background noise. Further, FFT may be supplemented by post processing curve fitting and ZCX may be implemented in a variety of different methods. Both methods may only involve a tone to be detected within a specific range rather than an exact frequency.

In yet another configuration, some of the communication nodes may be used to monitor operations after the installation of the gravel pack and associated equipment. For example, the communication nodes may be used to monitor the fluid flow or composition of fluids within the wellbore through the sand screens. The monitoring with the communication nodes may be performed on a continuous basis and/or during discrete time intervals. Thus, the communication nodes may be used during production operations to detect changes in the composition within the tubular member or sand screen (e.g., sand production or water breakthrough), changes in flux near the sand screens, and/or other property changes. The communication nodes may be a permanent installation system that may provide the capability to monitor the change of the gravel pack performance and thus adjust the production rate accordingly. The present techniques may increase the early production rate and ensure the gravel pack integrity.

In other configurations, a method of communicating data among a plurality of communication nodes is described. The method comprises: obtaining well data for a subsurface region; determining a communication network based on the obtained well data, wherein the communication network includes a plurality of communication nodes; installing the plurality of communication nodes into the wellbore and a gravel pack system, wherein one or more communication nodes of the plurality of communication nodes are configured to obtain measurements associated with a gravel pack location and to transmit the measurement data to other communication nodes in the communication network, and wherein the gravel pack system is disposed at the gravel pack location; performing gravel pack operations to install a gravel pack at the gravel pack location, wherein the performing gravel pack operations include: obtaining measurements near the gravel pack location with one of the one or more communication nodes during the gravel pack operations; and transmitting data packets associated with the obtained measurements from the one of the one or more communication nodes to a control unit via the communication network during the gravel pack operations; and performing hydrocarbon operations in the wellbore.

The method may include one or more enhancements. The method may further comprise adjusting gravel pack operations based on the transmitted data packets associated with the obtained measurements; further comprising determining voids or gaps in the gravel pack during the gravel pack operations; further comprising identifying one or more properties and the gravel pack location for the gravel pack installation; further comprising configuring the plurality of the communication nodes based on a communication network configuration; wherein the communication network configuration comprises selecting one of one or more frequency bands, one or more individual tones, one or more coding methods, and any combination thereof; further comprising producing hydrocarbons from the wellbore through the gravel pack; wherein the transmitting data packets comprises transmitting high-frequency signals that are greater than (>) 20 kilohertz; wherein the transmitting data packets comprises transmitting high-frequency signals that are in the range between greater than 20 kilohertz and 1 megahertz; wherein the performing gravel pack operations comprise: providing the gravel pack system that includes one or more sand screens, passing a carrier fluid into the wellbore, disposing the gravel or the gravel pack proppants adjacent to one or more sand screens to form the gravel pack, and conducting away a remaining portion of the carrier fluid through the one or more sand screens; further comprising: conditioning drilling fluid to remove solid particles from the drilling fluid, and combining the gravel or gravel pack propellants with the conditioned drilling fluid, wherein the conditioned drilling fluid is one of a solids-laden oil-based fluid, a solids-laden non-aqueous fluid, and a solids-laden water-based fluid; further comprising: obtaining measurements near the gravel pack location with one of the one or more communication nodes during the hydrocarbon operations, and transmitting data packets associated with the obtained measurements from the one of the one or more communication nodes to the control unit via the communication network during the hydrocarbon operations; further comprising determining flux near the gravel pack location with one of the one or more communication nodes based on the measured data; further comprising determining fluid composition near the gravel pack location with one of the one or more communication nodes based on the measured data; and/or further comprising determining pressure near the gravel pack location with one of the one or more communication nodes based on the measured data.

In yet another configuration, a hydrocarbon system is described. The hydrocarbon system comprises: a wellbore in a hydrocarbon system; a plurality of tubular members disposed in the wellbore; a communication network associated with the hydrocarbon system, wherein the communication network comprises a plurality of communication nodes that are configured to communicate operational data between two or more of the plurality of communication nodes during hydrocarbon operations; and a gravel pack monitoring system, wherein one or more communication nodes of the plurality of communication nodes are configured to obtain measurements near the gravel pack location and to transmit the measurement data to other communication nodes in the communication network.

The system may include one or more enhancements. The system may include wherein the one or more communication nodes of the plurality of communication nodes are configured to measure changes in pressure of fluids adjacent to the one or more communication nodes during the cementing installation operations; wherein the one or more communication nodes of the plurality of communication nodes are configured to measure changes in flux in a portion of the gravel pack; wherein the plurality of communication nodes are configured to transmit high-frequency signals that are greater than (>) 20 kilohertz; wherein the plurality of communication nodes are configured to transmit high-frequency signals that are in the range between greater than 20 kilohertz and 1 megahertz.

Beneficially, the present techniques provide various enhancements to the operations. Accordingly, the present techniques may be further understood with reference to FIGS. 1 to 4F, which are described further below.

FIG. 1 is an exemplary schematic representation of a well 100 configured to utilize a communication network having a gravel pack monitoring system that includes one or more communication nodes in accordance with certain aspects of the present techniques.

FIG. 1 is a schematic representation of a well 100 configured that utilizes a network having the proposed configuration of a gravel pack monitoring system that includes one or more communication nodes. The well 100 includes a wellbore 102 that extends from surface equipment 120 to a subsurface region 128. Wellbore 102 also may be referred to herein as extending between a surface region 126 and subsurface region 128 and/or as extending within a subterranean formation 124 that extends within the subsurface region. The wellbore 102 may include a plurality of tubular sections, which may be formed of carbon steel, such as a casing or liner. Subterranean formation 124 may include hydrocarbons. The well 100 may be used as a hydrocarbon well, a production well, and/or an injection well.

Well 100 also includes an acoustic wireless communication network. The acoustic wireless network also may be referred to herein as a downhole acoustic wireless network that includes various communication nodes 114 and a topside communication node and/or control unit 132. The communication nodes 114 may be spaced-apart along a tone transmission medium that extends along a length of wellbore 102. In the context of well 100, the tone transmission medium may include a downhole tubular 110 that may extend within wellbore 102, a wellbore fluid 104 that may extend within wellbore 102, a portion of subsurface region 128 that is proximal wellbore 102, a portion of subterranean formation 124 that is proximal wellbore 102, and/or a cement 106 that may extend within wellbore 102 and/or that may extend within an annular region between wellbore 102 and downhole tubular 110. Downhole tubular 110 may define a fluid conduit 108.

Communication nodes 114 may include one or more encoding components 116, which may be configured to generate an acoustic tone, such as acoustic tone 112, and/or to induce the acoustic tone within tone transmission medium. Communication nodes 114 also may include one or more decoding components 118, which may be configured to receive acoustic tone 112 from the tone transmission medium. The communication nodes 114 may function as both an encoding component 116 and a decoding component 118 depending upon whether the given node is transmitting an acoustic tone (e.g., functioning as the encoding component) or receiving the acoustic tone (e.g., functioning as the decoding component). The communication nodes 114 may include both encoding and decoding functionality, or structures, with these structures being selectively utilized depending upon whether or not the given communication node is encoding the acoustic tone or decoding the acoustic tone. In addition, the communication nodes 114 may optionally include sensing components that are utilized to measure, control, and monitor conditions within the wellbore 102.

In wells 100, transmission of acoustic tone 112 may be along a length of wellbore 102. As such, the transmission of the acoustic tone is substantially axial along the tubular member, and/or directed, such as by tone transmission medium. Such a configuration may be in contrast to more conventional wireless communication methodologies, which generally may transmit a corresponding wireless signal in a plurality of directions, or even in every direction.

To form a gravel pack in the portion of subterranean formation 124 that is proximal wellbore 102, a gravel pack system 140 may be utilized. The gravel pack system may include a cross over tool 142 and sand screen 146. The gravel pack system may also include a gravel monitoring system may include communication nodes 144, which may include similar components to the communication nodes 114 and be configured to exchange data packets with the communication nodes 114 and the control unit 132. The communication nodes 144 include one or more sensors that are configured to measure certain properties associated with the gravel pack area.

The plurality of frequencies, which are utilized in the communication nodes 114 and 144, may include the first frequency for a first type of communication node type and/or a second frequency for a second type of communication node type. Each of the wireless network types may be utilized in different configurations to provide the communication for the hydrocarbon operations. The respective frequency ranges may be any suitable values. As examples, each frequency in the plurality of high-frequency ranges may be at least 20 kilohertz (kHz), at least 25 kHz, at least 50 kHz, at least 60 kHz, at least 70 kHz, at least 80 kHz, at least 90 kHz, at least 100 kHz, at least 200 kHz, at least 250 kHz, at least 400 kHz, at least 500 kHz, and/or at least 600 kHz. Additionally or alternatively, each frequency in the plurality of high-frequency ranges may be at most 1,000 kHz (1 megahertz (MHz)), at most 800 kHz, at most 750 kHz, at most 600 kHz, at most 500 kHz, at most 400 kHz, at most 200 kHz, at most 150 kHz, at most 100 kHz, and/or at most 80 kHz. Further, each frequency in the low-frequency ranges may be at least 20 hertz (Hz), at least 50 Hz, at least 100 Hz, at least 150 Hz, at least 200 Hz, at least 500 Hz, at least 1 kHz, at least 2 kHz, at least 3 kHz, at least 4 kHz, and/or at least 5 kHz. Additionally or alternatively, each frequency in the high-frequency ranges may be at most 10 kHz, at most 12 kHz, at most 14 kHz, at most 15 kHz, at most 16 kHz, at most 17 kHz, at most 18 kHz, and/or at most 20 kHz.

Figure 2A:
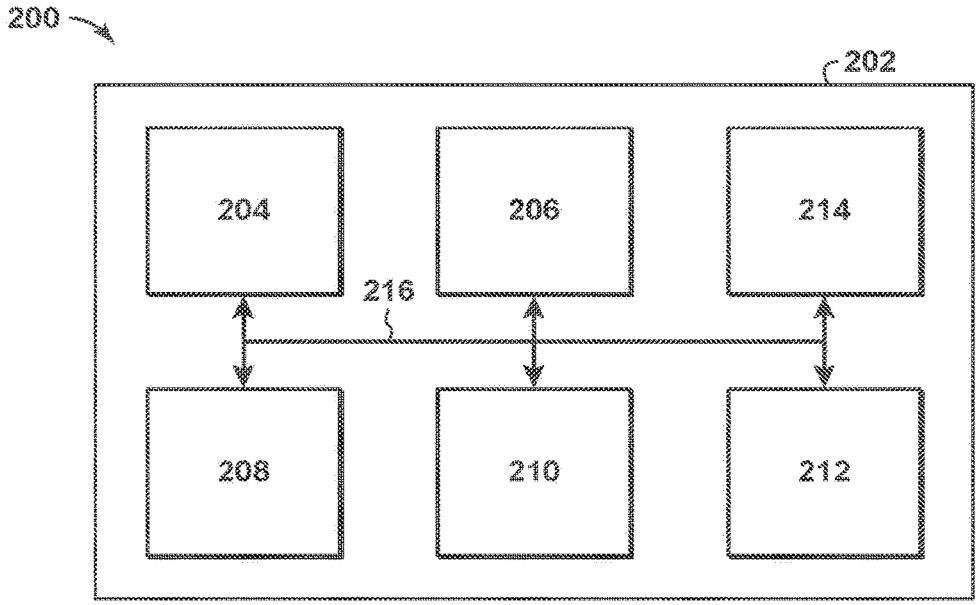
FIGS. 2A and 2B are exemplary views of communications nodes of FIG. 1.
Figure 2B:
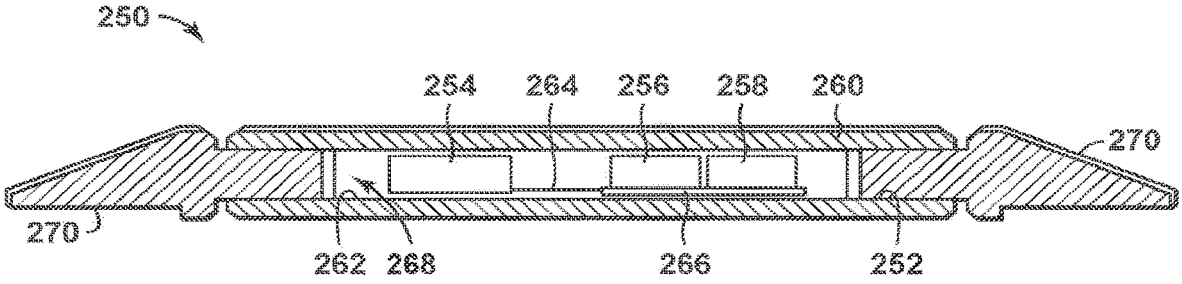

The communication nodes 114 and 144 may include various configurations, such as those described in FIGS. 2A and 2B. The communications node may be disposed on a conduit and/or a tubular section within the wellbore and may be disposed along or near a sand screen associated with a gravel pack location. The communication nodes may be associated with equipment, may be associated with tubular members and/or may be associated with the surface equipment. The communication nodes may also be configured to attach at joints, internal or external surfaces of conduits, surfaces within the wellbore, or to equipment. In a preferred configuration, an array of sensors may be used within each communication node. In such configurations, physical connections (e.g., wires) may be used to couple the sensors to master electronics in the communication node. Further, a long term (e.g., early production, such as during start-up) monitoring may be preferred to provide a permanent installation on the tubular members (e.g., casing and/or tubing) and extend to the sand screen area.

As a specific example, the communications nodes may be structured and arranged to attach to the surface (e.g., internal or external surface) of conduits at a selected location. This type of communication node may be disposed in a wellbore environment as an intermediate communications node between the surface and any communication nodes associated with the equipment and/or sensors. The communication nodes, which are primarily used for exchanging data packets within the wellbore, may be disposed on each tubular member, or may be disposed on alternative tubular members, while other communication nodes, which are primarily used for obtaining measurements and then exchanging data packets with other communication nodes within the wellbore, may be disposed on sand screens or other gravel pack equipment. By way of example, the communications node may be welded onto the respective surface or may be secured with a fastener to the tubular member (e.g., may be selectively attachable to or detachable from tubular member). The fastener may include the use of clamps (not shown), an epoxy or other suitable acoustic couplant may be used for chemical bonding. By attaching to the external surface of the tubular member, the communication nodes may not interfere with the flow of fluids within the internal bore of the tubular section. Further, the communication nodes may be integrated into the sand screen or disposed between the wire mesh of the sand screen and the associated ribs.

FIG. 2A is a diagram 200 of an exemplary communication node. The communication node 200 may include a housing 202 along with a central processing unit (CPU) 204, memory 206, which may include instructions or software to be executed by the CPU 204 one or more encoding components 208, one or more decoding components 210, a power component 212 and/or one or more sensing components 214, which communicate via a bus 216. The central processing unit (CPU) 204 may be any general-purpose CPU, although other types of architectures of CPU 204 may be used as long as CPU 204 supports the inventive operations as described herein. The CPU 204 may contain two or more microprocessors and may be a system on chip (SOC), digital signal processor (DSP), application specific integrated circuits (ASIC), and field programmable gate array (FPGA). The CPU 204 may execute the various logical instructions according to disclosed aspects and methodologies. For example, the CPU 204 may execute machine-level instructions for performing processing according to aspects and methodologies disclosed herein. The memory 206 may include random access memory (RAM), such as static RAM (SRAM), dynamic RAM (DRAM), synchronous DRAM (SDRAM), or the like, read-only memory (ROM), such as programmable ROM (PROM), erasable PROM (EPROM), electronically erasable PROM (EEPROM), or the like. In addition, the memory 206 may include NAND flash and/or NOR flash. Further, the power component 212 may be disposed in the housing 202 and may be configured to provide power to the other components. The power component 212 may include one or more batteries.

To manage the communications, the communication node 200 may utilize the one or more encoding components 208 and one or more decoding components 210 within the housing 202. The encoding components 208, which may include one or more transducers, may be disposed within the housing 202 and may be configured to generate an acoustic tones and/or to induce the acoustic tone on a tone transmission medium. The one or more decoding components 210, which may include one or more transducers, may be disposed within the housing 202 and may be configured to receive acoustic tones from the tone transmission medium. The encoding and decoding components 208 and 210 may include instructions stored in memory and utilized to perform the generation of the acoustic tones or decoding of the acoustic tones along with compression or decompression of the data packets into the acoustic tones. The encoding component 208 and decoding component 210 may utilize the same transducer in certain configurations.

The one and/or more sensing components 214 (e.g., sensors) may be configured to obtain sensing data and communicate the obtained measurement data to other communication nodes. By way of example, the sensing components 214 may be configured to obtain pressure measurements, temperature measurements, fluid flow measurements, vibration measurements, resistivity measurements, capacitance measurements, strain measurements, acoustics measurements, stimulation and/or hydraulic fracture properties measurements, chemicals measurements, position measurements and other suitable measurements. By way of example, the sensing components 214 may be configured to obtain measurements associated with the detection of voids or gaps in the gravel pack. The sensing components 214 may monitor parameters, such as density and/or pressure. With the existence of sand or other solids, the changes in density are gradual as the sand accumulates around the sand screening area. Flow measurement may also be utilized because as production sand increases, it slows down the flow rates with the same valve setting. Further, vibration, acoustics, stress, strain, and/or gamma ray may also be helpful to detect the existence or patterns of the sand accumulation.

In yet another exemplary configuration, FIG. 2B is an exemplary cross sectional diagram of a communications node 250 that may be used in the system. The view of the communication node 250 is along the longitudinal axis. The communications node 250 includes a housing 252, which may be fabricated from carbon steel or other suitable material to avoid corrosion at the coupling. The housing 252 is dimensioned to provide sufficient structural strength to protect internal components and other electronics disposed within the interior region. By way of example, the housing 252 has an outer wall 260, which may be about 0.2 inches (0.51 centimeters (cm)) in thickness. A cavity 262 houses the electronics, including, by way of example and not of limitation, a power source 254 (e.g., one or more batteries), a power supply wire 264, a first electro-acoustic transducer 256, a second electro-acoustic transducer 258, and a circuit board 266. The circuit board 266 may preferably include a micro-processor or electronics module that processes acoustic signals.

For communication between communication nodes, the first transducer 256 and the second transducer 258, which may each be electro-acoustic transducers, are provided to convert acoustical energy to electrical energy (or vice-versa) and are coupled with outer wall 260 on the side attached to the tubular member. As an example, the first transducer 256, which may be configured to receive acoustic signals, and a second transducer 258, which may be configured to transmit acoustic signals, are disposed in the cavity 262 of the housing 252. The first and second transducers 256 and 258 provide a mechanism for acoustic signals to be transmitted and received from node-to-node, either up the wellbore or down the wellbore. In certain configurations, the second electro-acoustic transducer 258, configured to serve as a transmitter, of intermediate communications nodes 250 may also produce acoustic telemetry signals. Also, an electrical signal is delivered to the second transducer 258 via a driver circuit. By way of example, a signal generated in one of the transducers, such as the second transducer 258, passes through the housing 252 to the tubular member, and propagates along the tubular member to other communications nodes. As a result, the transducers that generates or receives acoustic signals may be a magnetostrictive transducer (e.g., including a coil wrapped around a core) and/or a piezoelectric ceramic transducer. Regardless of the specific type of transducer, the electrically encoded data are transformed into a sonic wave that is carried through the walls of a tubular member in the wellbore. In certain configurations, a single transducer may serve as both the transmitter and receiver.

Further, the internals of communications nodes 250 may include a protective layer 268. The protective layer 268 resides internal to the wall 260 and provides an additional thin layer of protection for the electronics. This protective layer provides additional mechanical durability and moisture isolation. The intermediate communications nodes 250 may also be fluid sealed with the housing 252 to protect the internal electronics. One form of protection for the internal electronics is available using a potting material.

To secure the communication node to the tubular member, the intermediate communications nodes 250 may also optionally include a shoe 270. More specifically, the intermediate communications nodes 250 may include a pair of shoes 270 disposed at opposing ends of the wall 260. Each of the shoes 270 provides a beveled face that helps prevent the node 250 from hanging up on an external tubular body or the surrounding earth formation, as the case may be, during run-in or pull-out.

To enhance the performance, the communication nodes may be configured to manage different types of wireless networks. For example, a communication node may be configured to operate with different types of networks and may use different frequencies to exchange data, such as low frequencies, high frequencies and/or radio frequencies. Accordingly, the communication nodes may be configured to communicate with each of the types of communication networks and/or may be configured to transmit with one type of communication network and receive with another type of communication network. In certain configurations, the acoustic waves may be communicated in asynchronous packets of information comprising various separate tones. In other configurations, the acoustic telemetry data transfer may involve multiple frequency shift keying (MFSK). Any extraneous noise in the signal is moderated by using well-known analog and/or digital signal processing methods. This noise removal and signal enhancement may involve conveying the acoustic signal through a signal conditioning circuit using, for example, one or more bandpass filters.

As may be appreciated, the method of gravel packing may include monitoring to enhance the operations. The monitoring of the gravel pack installation may be performed in real time or may be performed concurrently with the gravel pack installation. Further, the monitoring may include obtaining one or more properties, determining voids or gaps in the gravel pack based on the measured properties, optionally visualizing a portion of the gravel pack and adjusting gravel pack operations based on the determined voids or gaps in the gravel pack. The determining voids or gaps in the gravel pack may include computing density, gamma ray, and/or pressure variation may be parameters to measured and verified. In other configurations, the communication nodes may be configured to exchange data packets with other devices, such as one or more hydrophones or other equipment.

By way of example, the communication nodes may be installed on the washpipe. In such a configuration, measured data may be collected before production (e.g., before or after gravel pack installation). With the data comparison, it may be possible to redo part of the installation based on the modeling of the gravel pack and/or the gravel pack may be topped off to add more gravel to specific sections of the gravel pack, as needed. Another adjustment based on a detected void or gap may involve adjusting the production plans to lessen stress on the formation. In particular, the production rate plans may be modified to more slowly ramp up production to maintain the gravel pack, as compared to a fully formed gravel pack. If it is communication network is a permanent installation on tubular members, then the monitoring may be extended to the start-up operations of production and may continue during production, which may be on a continuous basis or may be performed at discrete time intervals. In such configurations, the gravel pack performance may be monitored during production and adjust of the production rate may be performed based on the conditions indicated by the measured data. Accordingly, the full production may be performed in a more efficient manner and/or full production may be reached in a slower manner that lessens the risk of failure of the gravel pack.

Figure 3:
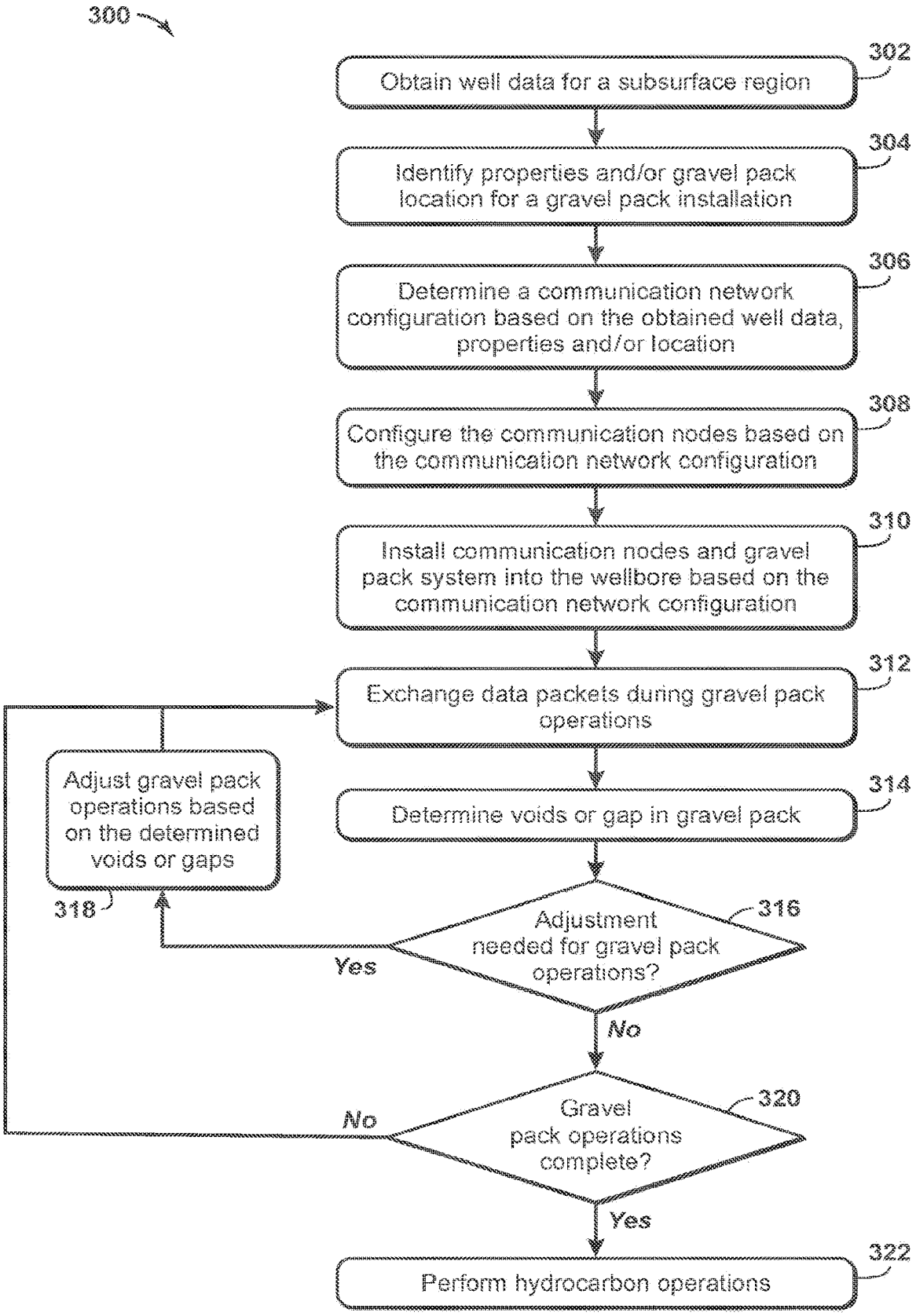
FIG. 3 is an exemplary flow chart in accordance with an embodiment of the present techniques.

FIG. 3 is an exemplary flow chart 300 in accordance with an embodiment of the present techniques. The flow chart 300 is a method for creating, installing and using a communication network in a wellbore associated with gravel pack operations. The method may include creating a communication network and installing the communication network in a wellbore along with a gravel pack system, as shown in blocks 302 to 310. Then, the communication network may be monitored and hydrocarbon operations are performed, as shown in blocks 312 to 322.

To begin, the method involves creating, installing and using a wireless network for a wellbore along with a gravel pack system, as shown in blocks 302 to 310. At block 302, well data for a subsurface region is obtained. The well data may include seismic data, electromagnetic data, resistivity data, gravity data, well log data, core sample data, and combinations thereof. The well data may be obtained from memory or from the equipment in the wellbore. The well data may also include the data associated with the equipment installed within the wellbore and the configuration of the wellbore equipment and/or hardware capabilities. For example, the well data may include the composition of the tubular members, thickness of the tubular members, length of the tubular members, fluid composition within the wellbore, formation properties, cementation within the wellbore and/or other suitable properties associated with the wellbore. At block 304, properties and/or a gravel pack location are identified. The gravel pack locations may be identified based on the predetermined locations near a subsurface region, which is predicted to include hydrocarbons. The properties may be identified because they may be used to monitor the gravel pack installation. The one or more properties may include density, flux, and/or pressure.

Then, at block 306, a communication network configuration is determined based on the obtained well data, properties and/or gravel pack location. The determining the communication network configuration may include determining locations for sensing properties, spacing of communication nodes, and one or more communication configuration settings. The creation of the communication network may include selecting acoustic frequency band and individual frequencies; optimizing the acoustic communication band for each pair of communication nodes; determining coding method for the network and/or determining selective modes for the network. Further, the communication network may be configured to manage different wireless network types. For example, a communication node may be configured to operate with different wireless network types, such as low frequency, high frequency and/or radio frequency. The creation of the communication network may include performing a simulation with a configuration of communication nodes, which may include modeling specific frequencies and/or use of certain wireless communication node types within specific zones or segments of the wellbore. The simulation may include modeling the tubular members, the communication of signals between communication nodes, the sensor locations and associated data and/or other aspects. The simulation results may include the computation of time-varying fluid pressure and fluid compositions and the prediction of signal travel times within the wellbore. Performing the simulation may also include modeling fluid, modeling signal transmissions and/or structural changes based on the network. In addition, the creation of the wireless network may include installing and configuring the communication nodes in the wireless network in a testing unit, which may include one or more tubular members and the associated communication nodes distributed along the tubular members within a housing or support structure. The testing unit may also contain a fluid disposed around the tubular member within the housing. The modeling may include theoretical work based on acoustic waveguide theory and/or a scale above grade lab system tests. Further, the modeling and/or historical experience may provide an estimate for the frequency ranges including the preferred tonal frequency separation. The tonal frequencies may not have to be equally spaced. The frequency range bandwidth may be constrained by both the acoustics of the channel and the capability of the transmission and reception electronics, including transmit and receive transducers. Likewise, the frequency spacing of the MFSK tones may be constrained by the tonal purity of the transmitted tone and resolution of the receiver decoder.

Then, the communication nodes are configured based on the communication network configuration, as shown in block 308. The configuration of the communication nodes may include programming or storing instructions into the respective communication nodes and any associated sensors to monitor operations, such as the gravel pack installation, and exchange data packets associated with the operations near the gravel pack location.

By way of example, the communication nodes may integrate with multiple sensors for property monitoring in the sensing area or gravel pack monitoring area. This configuration may include: measuring specific parameter; storing the measured data in the communication node; verifying the measured data (e.g., cross checking the measured parameter among adjacent communication nodes); identifying anomalies and/or flagging changes above a threshold with time. Another configuration may involve transferring data packets between the gravel pack location or sensing area and control unit at the topside of the wellbore. The communication nodes may include additional sensors, may interface with fiber optics that may detect-module to convert between freq. The communication node may involve one or more sensors that may include fiber optics, which may provide continuous measured data along the entire gravel pack and/or portions of the gravel pack.

At block 310, the communication nodes and gravel pack system are installed into the wellbore based on the communication network configuration. The installation of the communication nodes in the network may include disposing the communication nodes within the wellbore, which may be secured to tubular members and near sand screens. The installation of the communication network, which may include one or more wireless networks, may include verification of the communication network by performing testing, may include distribution of the sensors and/or verification of the communication nodes in the proposed network configuration.

Then, the communication network may be monitored and hydrocarbon operations are performed, as shown in blocks 312 to 322. At block 312, the data packets are exchanged during gravel pack operations. The exchange of data packets may involve the transmission of commands for equipment and/or measurement data and the associated reception of the transmissions. During the gravel pack operations may include activities during preparation of the communication nodes prior to installation into the wellbore or while the equipment is being run into the wellbore, activities prior to and during the disposing of the gravel into the wellbore adjacent to the sand screens, and/or after the installation of the gravel pack. At block 314, voids or gaps in gravel pack are determined. The determination of voids or gaps may involve computing comparisons of the measurement data obtained from one or more sensors. With the existence of voids and/or gaps, the pressure and density measurement may be different from other regions. After combining and/or comparing the density and/or pressure distributions, the voids or gaps may be identified. Because the node identify may be pre-defined, the location of the communication nodes with significant pressure and/or density measurement differences may be located. The remedy procedure may be initiated to enhance the gravel pack in this specific area. Flow measurement may also provide similar indications, because the flow rate may be different from other areas if there are voids and gaps. At block 316, a determination is made whether an adjustment is needed for gravel pack operations. The determination may include determining the presence and location of voids or gaps and/or whether a notification has been indicated that an adjustment is needed. If an adjustment is needed, the gravel pack operations may be adjusted based on the determined voids or gaps, as shown in block 318. The adjustment to the gravel pack operations may include re-pumping a portion of the gravel pack in this area.

If an adjustment is not needed, a determination is made whether gravel pack operations are complete in block 320. The determination of gravel pack operations being complete may include passing certain pressure, density, flow rate and/or any combination thereof, which may be above a threshold. The determination may include a pressure threshold, pressure signatures; and/or may also include additional density and other properties. If the gravel pack operations are not complete, the data packets may continue to be exchanged during gravel pack operations, as shown in block 312. If the gravel pack operations are complete, the hydrocarbon operations may be performed, as shown in block 322. The hydrocarbon operations may involve using the gravel pack to recovery hydrocarbons from the subsurface region. The hydrocarbon operations may include hydrocarbon exploration operations, hydrocarbon development operations, collection of wellbore data, and/or hydrocarbon production operations. For example, the communication network may be used to enhance the gravel pack operations and/or composition of the fluids being produced from the well. As another example, the communication network may be used to adjust hydrocarbon production operations, such as installing or modifying equipment for a completion associated with the gravel pack, which may be based on the produced fluids. Further, the communication network may be utilized to predict hydrocarbon accumulation within the subsurface region based on the monitored produced fluids; to provide an estimated recovery factor; and/or to determine rates of fluid flow for a subsurface region. The production facility may include one or more units to process and manage the flow of production fluids, such as hydrocarbons and/or water, from the formation.

Beneficially, the method provides an enhancement in the production, development, and/or exploration of hydrocarbons. In particular, the method may be utilized to enhance communication within the wellbore by providing a specific configuration that optimizes communication for gravel pack operations. Further, as the communication is provided in real time or concurrently with gravel pack operations, the communication network may provide enhancements to production at lower costs and lower risk. As a result, the present techniques lessen completion time due to monitoring the gravel pack installation in real time or con currently with the installation.

As may be appreciated, the blocks of FIG. 3 may be omitted, repeated, performed in a different order, or augmented with additional steps not shown. Some steps may be performed sequentially, while others may be executed simultaneously or concurrently in parallel. By way of example, the communication network may be adjusted or modified while the data packets are exchanged by performing various steps. For example, the method may include performing adjustments or modification of the selected acoustic frequency bands and individual frequencies. The acoustic frequency band and individual frequencies may include each frequency in the plurality of high-frequency ranges, which may be at least 20 kilohertz (kHz), at least 25 kHz, at least 50 kHz, at least 60 kHz, at least 70 kHz, at least 80 kHz, at least 90 kHz, at least 100 kHz, at least 200 kHz, at least 250 kHz, at least 400 kHz, at least 500 kHz, and/or at least 600 kHz. Additionally or alternatively, each frequency in the plurality of high-frequency ranges may be at most 1,000 kHz (1 megahertz (MHz)), at most 800 kHz, at most 750 kHz, at most 600 kHz, at most 500 kHz, at most 400 kHz, at most 200 kHz, at most 150 kHz, at most 100 kHz, and/or at most 80 kHz. Further, each frequency in the low-frequency ranges may be at least 20 hertz (Hz), at least 50 Hz, at least 100 Hz, at least 150 Hz, at least 200 Hz, at least 500 Hz, at least 1 kHz, at least 2 kHz, at least 3 kHz, at least 4 kHz, and/or at least 5 kHz. Additionally or alternatively, each frequency in the high-frequency ranges may be at most 10 kHz, at most 12 kHz, at most 14 kHz, at most 15 kHz, at most 16 kHz, at most 17 kHz, at most 18 kHz, and/or at most 20 kHz. Further, the acoustic communication bands and individual frequencies for each pair of communication nodes may be optimized, which may include determining the explicit MFSK frequencies. Also, the coding methods for the communication network may be determined. In addition, the clock ticks may be optimized to maximize data communication rate. For example, the coding method may be selected based on availability of frequency bands and/or communication rates may be compromised if the frequency band is limited. In certain configurations, the coding method may include performing frequency combining based on one or more clock ticks per tone (e.g., one clock tick per tone, two clock ticks per tone, three clock ticks per tone, and/or more clock ticks per tone) to achieve more or fewer tones within a frequency band.

Further, as communication nodes may be configured with a setting or profile, the settings may include various parameters. The settings may include acoustic frequency band and individual frequencies (e.g., acoustic communication band and individual frequencies for each pair of communication nodes); and/or coding methods (e.g., establishing how many tones to use for MFSK (2, 4, 8, . . . ) and/or whether to use direct mapping or spread spectrum), and/or tone detection method, such as FFT, ZCR and other methods. The settings may include frequency combining using one or more clock ticks per tone. The tones may be selected to compensate for poor acoustic propagation.

By way of example, the gravel pack operations may be performed with a variety of techniques. The method may include drilling a well to access a subsurface region with a drilling fluid (e.g., water based fluid, non-aqueous fluid or oil based fluid); optionally passing a conditioning or filtering the drilling fluid to remove solids above a specific threshold; running a gravel pack assembly tools into the wellbore to a depth near the gravel pack location with a carrier fluid (e.g., conditioned fluid or a separate fluid); setting the gravel pack assembly tools near the gravel pack location; disposing the carrier fluid having the gravel or gravel pack proppants into the wellbore near the gravel pack location and removing the carrier fluid from the gravel pack location without the gravel through the sand screen. The gravel pack operations may include using a cross over tool in the fluid flow to manage the different fluids that may be used within the gravel pack operations. For open-hole completions, the gravel packed may include non-uniform grain size distributions. In yet another configuration, the method may include drilling a well to access a subsurface region with a drilling fluid; optionally passing a conditioning or filtering the drilling fluid to remove solids above a specific threshold; running a gravel pack assembly tools (e.g., one or more sand screens) into the wellbore to a depth near the gravel pack location; setting the gravel pack assembly tools near the gravel pack location; disconnecting the gravel pack assembly tools; and running production tubing into the wellbore; and/or coupling production tubing gravel pack assembly tools. The gravel pack operations may involve using the formation to form the gravel pack based on the production of sand.

In the gravel pack operations, various fluids may be used to manage the installation of the gravel pack into the wellbore. Examples of the water-based carrier fluid include but are not limited to a fluid viscosified with HEC polymer, xanthan polymer, visco-elastic surfactant (VES) or combinations thereof. Persons skilled in the art will recognize other carrier fluids that may be chosen because of their favorable properties. The carrier fluid may be a solids-laden oil-based fluid, a solids-laden non-aqueous fluid, and a solids-laden water-based fluid. In addition, the conditioning of the drilling fluid may remove solid particles larger than approximately one-third the opening size of the sand control device or larger than one-sixth the diameter of the gravel pack particle size. Further, the carrier fluid may be chosen to have favorable rheology for effectively displacing the conditioned fluid and may be any one of a fluid viscosified with HEC polymer, a xanthan polymer, a visco-elastic surfactant (VES), and any combination thereof. The use of visco-elastic surfactants as a carrier fluid for gravel packing has been disclosed in at least U.S. Pat. No. 6,883,608, the portions of which dealing with gravel packing with VES are hereby incorporated by reference.

To enhance the gravel pack operations, the communication network may involve transmitting acoustic signals during gravel pack operations, as described further in FIGS. 4A to 4J. For example, FIGS. 4A to 4J are diagrams 400, 420, 430, 440, 450, 460, 470, 480, 490, 491 and 492 of exemplary embodiments of the method of FIG. 3 in accordance with certain aspects of the present techniques. The gravel pack operations typically include disposing the gravel pack assembly and sand screens to a specific location and then displacing various fluids to set the gravel pack at the gravel pack location. For example, the displacement of fluids may be performed to remove conditioned drilling fluid and drill cuttings that remain in the wellbore before the circulating the carrier fluid to deposit the gavel or gravel pack proppants in the wellbore adjacent to the sand screen. The gravel pack system may include a coupling assembly and joint assembly in combination with a variety of well tools, such as a packer (e.g., open-hole packer), a sand control device, inflow control devices or a shunted blank. In these configurations, various communication nodes may be disposed on the sand screens to provide monitoring and measurement data.

Figure 4A:
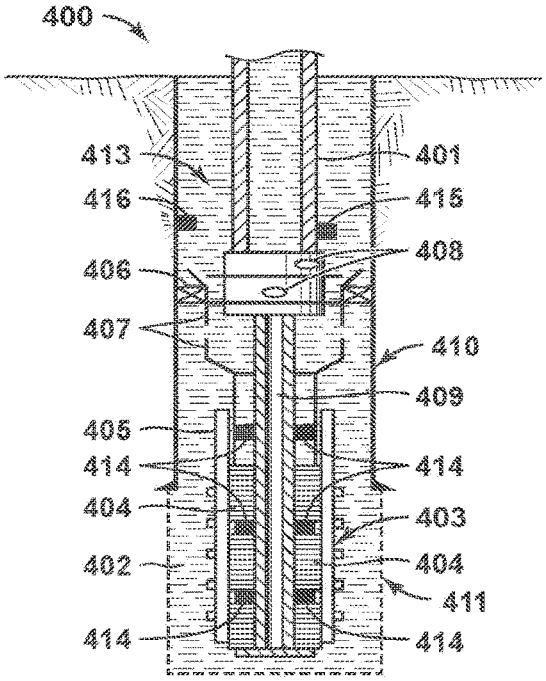
FIGS. 4A to 4J are diagrams of an exemplary embodiments of the method of FIG. 3 in accordance with certain aspects of the present techniques.

FIG. 4A illustrates a diagram 400 of a system having a joint assembly 403 disposed in a wellbore 402, the joint assembly 403 having a screen 404 with alternate path technology 405 (e.g. shunt tubes). The system 400 consists of a screen 404, shunt tubes 405, a packer 406 (the process may be used with an open-hole or cased hole packer), and a crossover tool 407 with fluid ports 408 connecting the drillpipe 401, washpipe 409 and the annulus of the wellbore 402 above and below the packer 406. This wellbore 402 consists of a cased section 410 and a lower open-hole section 411. Typically, the gravel pack assembly is lowered and set in the wellbore 402 on a drillpipe 401. The non-aqueous fluid 413 in the wellbore 402 had previously been conditioned over mesh shakers (not shown) and passed through a screen sample (not shown), which may be two to three gauge sizes smaller than the gravel pack screen 404 in the wellbore 402.

To enhance the gravel pack operations, the communication nodes 414, 415 and 416 may be used to exchange data and monitor gravel pack operations. The communication nodes 414 may be distributed around sand screen, such as adjacent to the shunt tubes 405 and washpipe 409, while the communication node 415 may be coupled to the drillpipe 401 and the communication node 416 may be coupled to the cased section 410. The communication nodes 414 may include one or more sensors, while the communication nodes 415 and 416 may not include sensors. The communication nodes 415 and 416 may be used to exchange data packets to other communication nodes and to a control unit, which may be performed concurrently or in real time.

Further, some of the communication nodes may be used as a temporary measurement, while other communication nodes may be used as part of a permanent installation. By way of example, the sand screen and any associated communication nodes are part of the permanent installation, which may also include the production tubing and any associated communication nodes. The temporary installations may include the drill pipe and any communication nodes associated with the drill pipe.

Figure 4B:
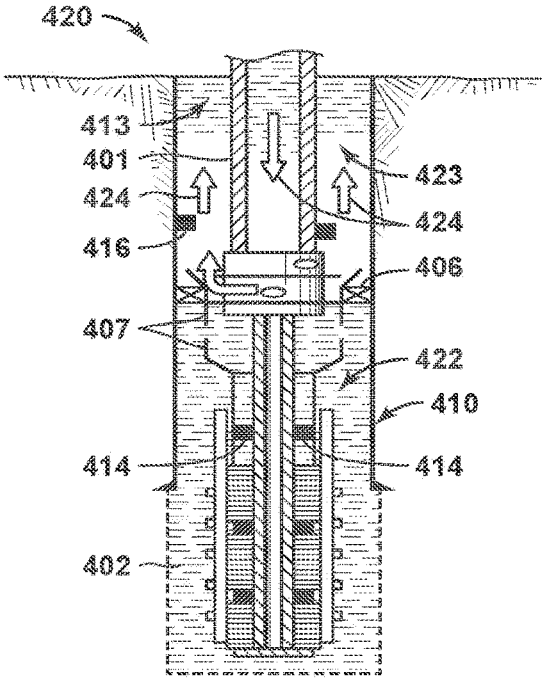

As illustrated in FIG. 4B, a diagram 420 includes the packer 406 that is set in the wellbore 402 directly above the interval to be gravel packed 422. The packer 406 seals the interval from the rest of the wellbore 402. After the packer 406 is set, the crossover tool 407 is shifted into the reverse position and neat gravel pack fluid 423 is pumped down the drillpipe 401 and placed into the annulus between the casing 410 and the drillpipe 401, displacing the conditioned oil-based fluid 413. The arrows 424 indicate the flow path of the fluid. The neat fluid 423 may be a solids free water based pill or other balanced viscosified water based pill.

Figure 4C:
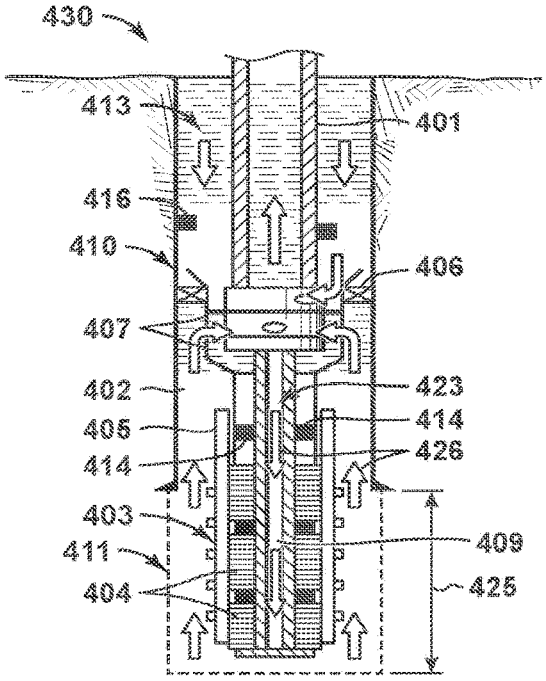
Figure 4C:
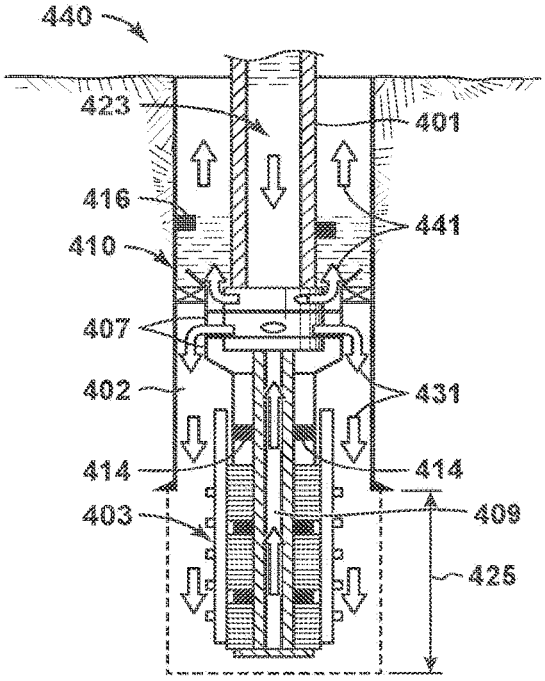

Next, as illustrated in FIG. 4C, a diagram 430 includes the crossover tool 407 that is shifted into the circulating gravel pack position. Conditioned non-aqueous fluid 413 is then pumped down the annulus between the casing 410 and the drillpipe 401 pushing the neat gravel pack fluid 423 through the washpipe 409, out the screens 404, sweeping the open-hole annulus 425 between the joint assemblies 403 and the open-hole 411 and through the crossover tool 407 into the drillpipe 401. The arrows 426 indicate the flow path through the open-hole 411 and the alternate path tools 405 in the wellbore 402.

The step illustrated in FIG. 4C may alternatively be performed as shown in the FIG. 4C', which may be referred to as the "reverse" of FIG. 4C. In FIG. 4C', a diagram 440 includes the conditioned non-aqueous fluid 413 that is pumped down the drillpipe 401, through the crossover tool 407 and out into the annulus of the wellbore 402 between the joint assemblies 403 and the casing 410 as shown by the arrows 431. The flow of the non-aqueous fluid 413 forces the neat fluid 423 to flow down the wellbore 402 and up the washpipe 409, through the crossover tool 407 and into the annulus between the drillpipe 401 and the casing 410 as shown by the arrows 441.

Figure 4D:
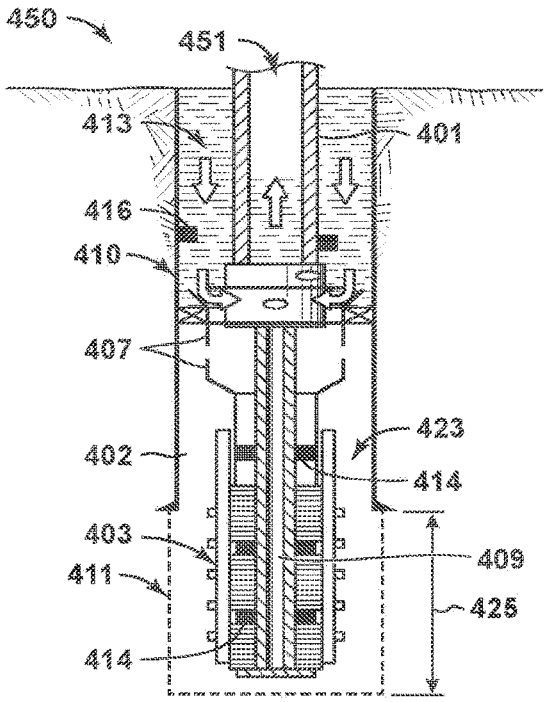

As illustrated in FIG. 4D, a diagram 450 represents the next step. Once the open-hole annulus 425 between the joint assemblies 403 and the open-hole 411 has been swept with neat gravel pack fluid 423, the crossover tool 407 is shifted to the reverse position. Conditioned non-aqueous fluid 413 is pumped down the annulus between the casing 410 and the drillpipe 401 causing a reverse-out by pushing non-aqueous fluid 413 and dirty gravel pack fluid 451 out of the drillpipe 401. Note that the steps illustrated in this diagram 450 may be reversed in a manner similar to the steps in diagrams 430 and 440. For example, the non-aqueous fluid 413 may be pumped down the drillpipe 401 through the crossover tool 407 pushing non-aqueous fluid 413 and dirty gravel pack fluid 451 up the wellbore 402 by sweeping it through the annulus between the drillpipe 401 and the casing 410.

Figure 4E:
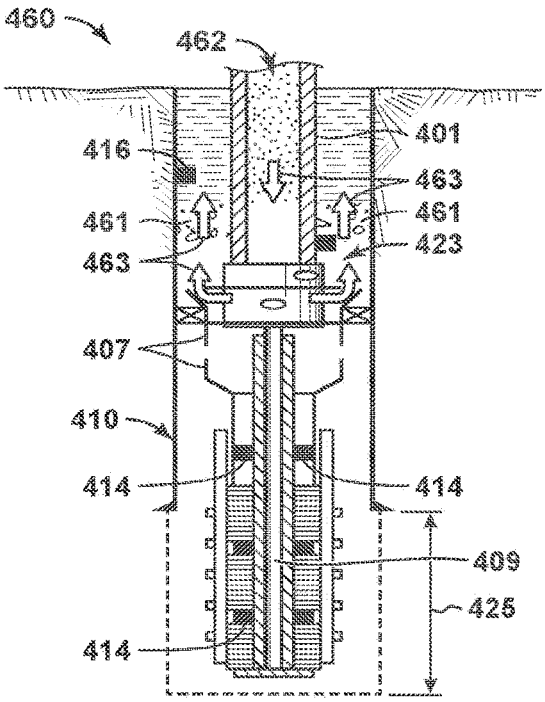

Next, as illustrated in FIG. 4E, a diagram 460 represents the next step. While the crossover tool 407 remains in the reverse position, a viscous spacer 461, neat gravel pack fluid 423 and gravel pack slurry 462 are pumped down the drillpipe 401. The arrows 463 indicate direction of fluid flow of fluid while the crossover tool 407 is in the reverse position. After the viscous spacer 461 and 50% of the neat gravel pack fluid 423 are in the annulus between the casing 410 and drillpipe 401, the crossover tool 407 is shifted into the circulating gravel pack position.

Figure 4F:
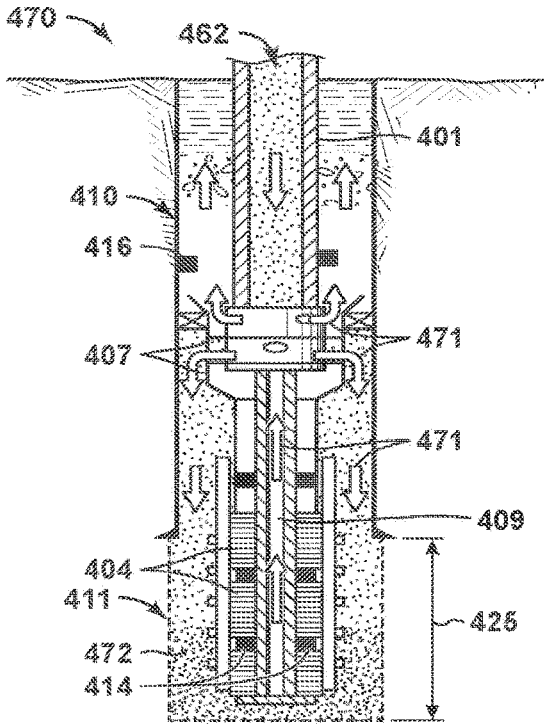

Next, as illustrated in FIG. 4F, a diagram 470 includes the appropriate amount of gravel pack slurry 462 to pack the open-hole annulus 425 between the joint assemblies 403 and the open-hole 411 is pumped down the drillpipe 401, with the crossover tool 407 in the circulating gravel pack position. The arrows 471 indicate direction of fluid flow of fluid while the crossover tool 407 is in the gravel pack position. The pumping of the gravel pack slurry 462 down the drillpipe 401, forces the neat gravel pack fluid 423 to leak off through the screens 404, up the washpipe 409 and into the annulus between the casing 410 and the drillpipe 401. This leaves behind a gravel pack 472. Conditioned non-aqueous fluid 413 returns are forced up through the annulus between the casing 410 and the drillpipe 401 as the neat gravel pack fluid 423 enters the annulus between the casing 410 and the drillpipe 401.

Figure 4G:
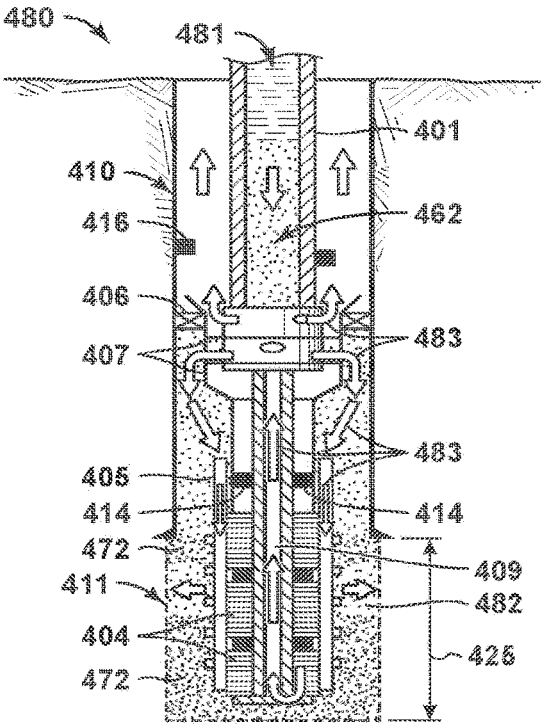

As illustrated in FIG. 4G, the gravel pack slurry 462 is then pumped down the drillpipe 401 by introducing a completion fluid 481 into the drillpipe 401. The gravel pack slurry 462 displaces the conditioned non-aqueous fluid (not shown) out of the annulus between the casing 410 and the drillpipe 401. Next, more gravel pack 472 is deposited in the open-hole annulus 425 between the joint assembly tools 403 and the open-hole 411. If a void 482 in the gravel pack 472 (e.g. below a sand bridge) forms as shown in FIG. 4G, then gravel pack slurry 462 is diverted into the shunt tubes 405 of the joint assembly tool 403 and resumes packing the open-hole annulus 425 between the alternate path tools 403 and the open-hole 411 and below the sand bridge 482. The arrows 483 illustrate the fluid flow of the gravel pack slurry down the drillpipe 401 through the crossover tool 407 into the annulus of the wellbore below the packer 406. The gravel pack slurry 462 then flows through the shunt tubes 405 of the joint assembly tool 403 and fills any voids 482 in the open-hole annulus 425. The arrows 483 further indicate the fluid flow of the neat gravel pack fluid 423 through the screens 404 and up the washpipe 409 through the crossover tool 407 in the annulus between the casing 410 and the drillpipe 401.

Figure 4H:
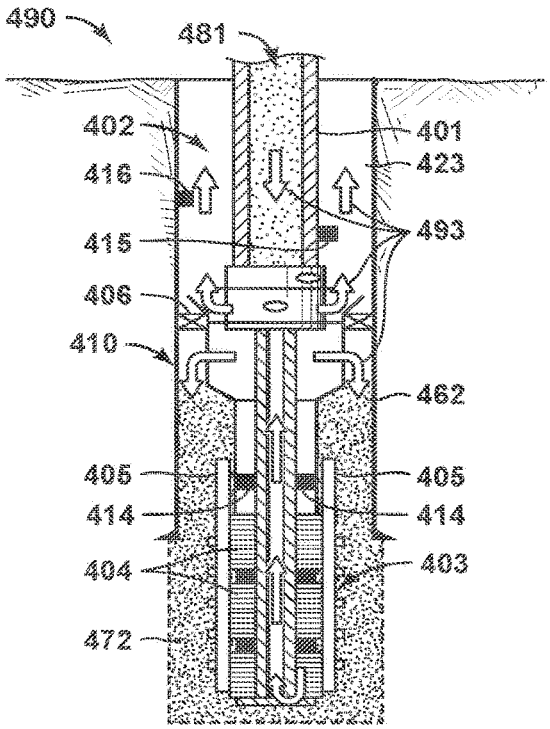

FIG. 4H is a diagram 490 that illustrates a wellbore 402 immediately after fully packing the annulus between the screen 404 and casing 410 below the packer 406. Once the screen 404 is covered with gravel pack 472 and the shunt tubes 405 of the joint assemblies 403 are full of sand, the drillpipe 401 fluid pressure increases, which is known as a screenout. The arrows 493 illustrate the fluid flowpath as the gravel pack slurry 462 and the neat gravel pack fluid 423 is displaced by completion fluid 481.

Figure 4I:
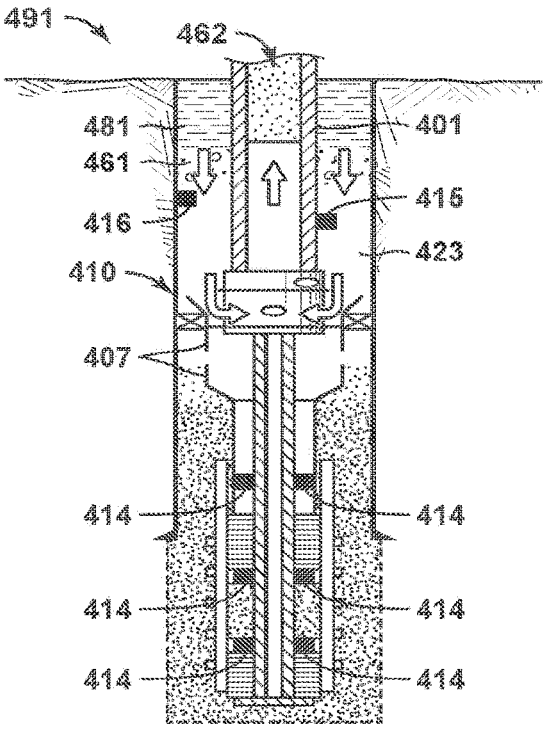

FIG. 4I is a diagram 491 that illustrates the crossover tool 407 being shifted to the reverse position, after a screenout occurs. A viscous spacer 461 is pumped down the annulus between the drillpipe 401 and the casing 410 followed by completion fluid 481 down the annulus between the casing 410 and the drillpipe 401. Thus, creating a reverse-out by pushing the remaining gravel pack slurry 462 and neat gravel pack fluid 423 out of the drillpipe 401.

Figure 4J:
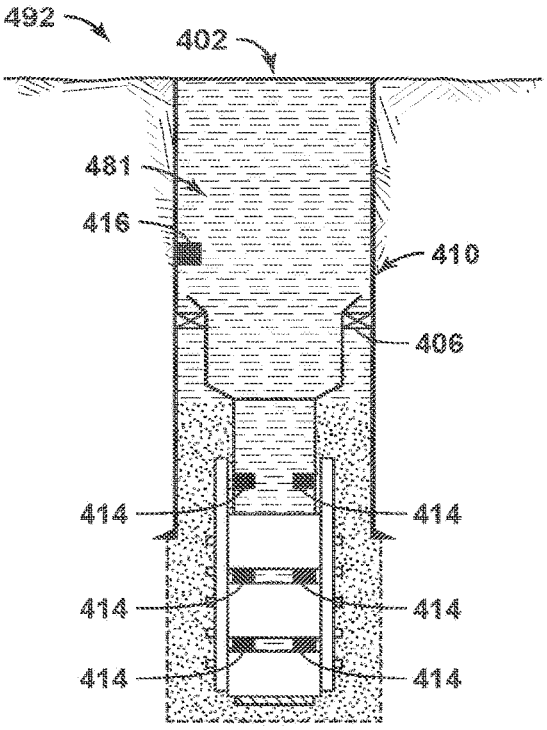

Finally, as shown in diagram 492 of FIG. 4J, the fluid in the annulus between the casing 410 and the drillpipe 401 (not shown) has been displaced with completion brine 481, and the crossover tool 407 (not shown), washpipe 409 (not shown), and drillpipe 401 (not shown) are pulled out of the wellbore 402 leaving behind a fully-packed well interval below the packer 406.

In an exemplary configuration, another device may be run down the basepipe for use during production after removal of the washpipe 409. For example, the intelligent well assembly may be run inside the basepipe and attached to the joint assembly 403 through seals between the device and the bore of a packer assembly. Such device may include a flexible profile completion or other suitable device.

Referring back to the steps illustrated in FIGS. 4F and 4G, when the gravel pack fluid 423 leaks off into the screen 404 and up the washpipe 409 it is desirable to control the profile of the fluid leakoff. In an openhole completion, fluid leakoff into the formation is limited due to the mud filter cake (not shown) formed on the wellbore 402 during the drilling phase. In a cased-hole completion, fluid leakoff into the formation is quickly reduced as the perforation tunnels (not shown) are packed with gravel 472.

It has been desired to keep slurry 462 flowing down the annulus between the wellbore 402 and the screen 404 and pack the gravel 472 in a bottom-up manner. Various methods of controlling the profile of fluid leakoff into the screen 404 have been proposed, including control of the annulus between the washpipe 409 and the basepipe (e.g., ratio of washpipe outer diameter (OD) to basepipe inner diameter (ID) greater than 0.8) and baffles (not shown) on the washpipe 409. Examples of such are provided in U.S. Pat. Nos. 3,741,301; 3,637,010.

The gravel packing screens may include a space between the screen 404 and the associated basepipe, which is smaller than the annulus between washpipe 409 and basepipe. The space between the screen 404 and the basepipe may be in the range of 2 to 5 millimeters (mm), which is smaller than the annulus between washpipe 409 and basepipe that is between 6 mm to 16 mm. Therefore, the annulus between the washpipe 409 and the associated basepipe has been historically the design focus to manage fluid leakoff. In very long intervals (e.g. more than 3,500 feet), the restricted annulus between the washpipe 409 and the associated basepipe may impose more significant friction loss for fluid leakoff, which is necessary to form a gravel pack 472 in the wellbore 402. In certain applications, the washpipe 409 is equipped with additional devices (e.g., releasing collet to shift sleeves for setting packers). Depending on the type and number of these additional devices, they may result in extra friction loss along the annular fluid leakoff paths.

Placing the shunt tubes 405 inside of the screen 404 increases the spacing between the screen 404 and the associated basepipe (e.g., from about 2 mm to 5 mm to about 20 mm). The total outside diameter is comparable to the alternate path screen with external shunt tubes. The size of basepipe remains the same. However, the extra space between the screen 404 and the associated basepipe reduces the overall friction loss of fluid leakoff and promotes the top-down gravel packing sequence by the shunt tubes 405.

In other configurations, another benefit of having the shunt tubes 405 below the wire-wrapped screen 404 is the increased flow area into the screens 404 during production. The screen 404 outer diameter may be increased to about seven or eight inches compared to the same size basepipe with conventional shunt tubes (e.g., screen outer diameter of about five to six inches). Thus, the screen outer diameter is increased by about 25 percent (%). Using the screens 404 with the increased outer diameter further beneficially decreases the amount of gravel and fluid involved to pack the openhole by the screen annulus.

To construct sand screens, a screen is wrapped on a base pipe to form a screen filter or sand screen. Accordingly, a combination of rib wires may run axially along the length of the pipe (e.g., this provides the standoff or space under the wrap wire) and wrap wires that create the sand control filter as they are wrapped radially around the pipe. While the axial wires may be formed in keystone shapes (e.g., roughly similar to a triangle) and are available in the following sizes. As may be appreciated, the sand screens may include various standoff variations, which as short, medium and high standoff variations. Accordingly, the communication nodes may be disposed between the screen and the base pipe. In other configurations, the communication nodes and/or sensors may be installed above the screen. The configuration may include installing the communication nodes may be on the shunt screen. The configuration may include installing the communication nodes above the sand screen, which may be protected by an outer shroud. Disposing the communication nodes on the screen may be challenging due to poor acoustic bonding and may not be able to send data to other communication nodes. Accordingly, communication nodes may be disposed within the internal region of the tubular member and sensors may be disposed under and/or above the screen depending on the standoff variation. The sensors may be wired-connected with communication nodes in a short distance.

Further, the communication nodes may be distributed in various configurations based on the preferred density of the measurements. For discrete measurements along wellbore, the communication nodes or associated sensor arrays may be within a range to provide coverage for specific portions of the wellbore, which may depend upon the preferred resolution (e.g., vertical resolution and/or horizontal resolution). As gravel packs may be as long as 600 meter or 1,500 meters in length, the communication nodes may be configured to provide continuous fiber optics, and/or may be adjusted based on the resolution and/or property being measured. For example, the sensors for the communication node may be spaced apart within a range of 100 feet, and/or in a range between 1 foot and 40 feet.

Figure 5:
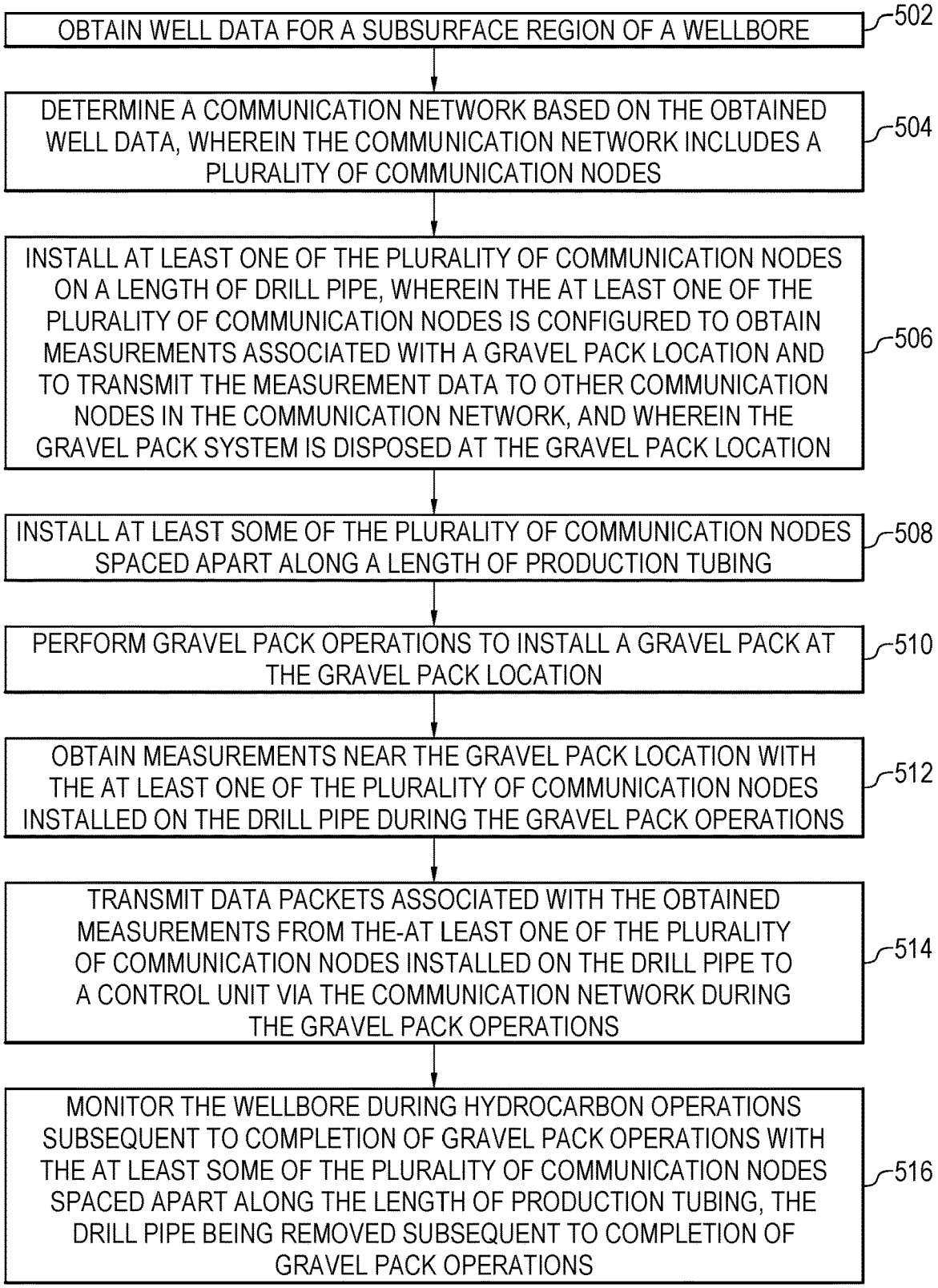
FIG. 5 is an exemplary flow chart in accordance with an embodiment of the present techniques.

FIG. 5 is an exemplary flow chart 500 in accordance with an embodiment of the present techniques. The flow chart 500 shows a method of communicating data among a plurality of communication nodes, as described herein. At block 502, well data is obtained for a subsurface region of a wellbore. Block 504 shows determining a communication network based on the obtained well data, wherein the communication network includes a plurality of communication nodes. Block 506 shows installing at least one of the plurality of communication nodes on a length of drill pipe, wherein the at least one of the plurality of communication nodes is configured to obtain measurements associated with a gravel pack location and to transmit the measurement data to other communication nodes in the communication network. The gravel pack system is disposed at the gravel pack location.

Block 508 shows installing at least some of the plurality of communication nodes spaced apart along a length of production tubing. Block 510 shows performing gravel pack operations to install a gravel pack at the gravel pack location, wherein the performing gravel pack operations include the steps shown in blocks 512, 514 and 516.

Block 512 shows obtaining measurements near the gravel pack location with the at least one of the plurality of communication nodes installed on the drill pipe during the gravel pack operations. Block 514 shows transmitting data packets associated with the obtained measurements from the—at least one of the plurality of communication nodes installed on the drill pipe to a control unit via the communication network during the gravel pack operations. Block 516 shows monitoring the wellbore during hydrocarbon operations subsequent to completion of gravel pack operations with the at least some of the plurality of communication nodes spaced apart along the length of production tubing, the drill pipe being removed subsequent to completion of gravel pack operations.

Figure 6:
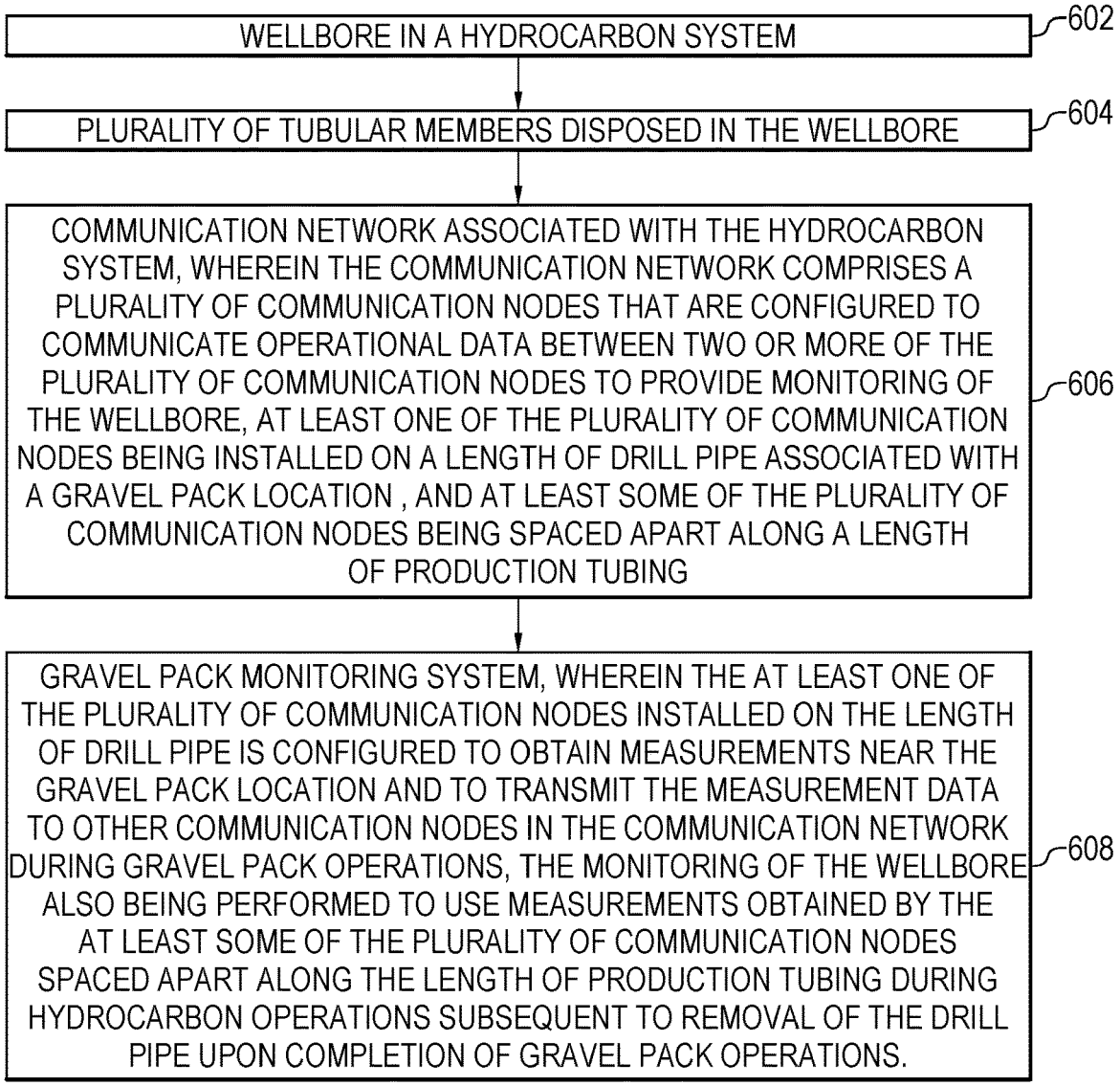
FIG. 6 is an exemplary system diagram showing a hydrocarbon system in accordance with an embodiment of the present techniques.

FIG. 6 is an exemplary system diagram showing a hydrocarbon system 600 in accordance with an embodiment of the present techniques. Block 602 shows a wellbore in the hydrocarbon system. Block 604 shows a plurality of tubular members disposed in the wellbore.

Block 606 shows a communication network associated with the hydrocarbon system, wherein the communication network comprises a plurality of communication nodes that are configured to communicate operational data between two or more of the plurality of communication nodes to provide monitoring of the wellbore, at least one of the plurality of communication nodes being installed on a length of drill pipe associated with a gravel pack location, and at least some of the plurality of communication nodes being spaced apart along a length of production tubing. Block 608 shows a gravel pack monitoring system, wherein the at least one of the plurality of communication nodes installed on the length of drill pipe is configured to obtain measurements near the gravel pack location and to transmit the measurement data to other communication nodes in the communication network during gravel pack operations, the monitoring of the wellbore also being performed to use measurements obtained by the at least some of the plurality of communication nodes spaced apart along the length of production tubing during hydrocarbon operations subsequent to removal of the drill pipe upon completion of gravel pack operations.

Persons skilled in the technical field will readily recognize that in practical applications of the disclosed methodology, it is partially performed on a computer, typically a suitably programmed digital computer or processor based device. Further, some portions of the detailed descriptions which follow are presented in terms of procedures, steps, logic blocks, processing and other symbolic representations of operations on data bits within a computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "processing" or "computing", "calculating", "comparing", "determining", "displaying", "copying," "producing," "storing," "adding," "applying," "executing," "maintaining," "updating," "creating," "constructing" "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

Embodiments of the present techniques also relate to an apparatus for performing the operations herein, such as monitoring and communicating. This apparatus, such as the control unit or the communication nodes, may be specially constructed for the required purposes, or it may comprise a general-purpose computer or processor based device selectively activated or reconfigured by a computer program stored in the computer (e.g., one or more sets of instructions). Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), NAND flash, NOR flash, magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.)).

Furthermore, as will be apparent to one of ordinary skill in the relevant art, the modules, features, attributes, methodologies, and other aspects of the invention can be implemented as software, hardware, firmware or any combination of the three. Of course, wherever a component of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present techniques are in no way limited to implementation in any specific operating system or environment.

By way of example, the control unit may include a computer system that may be used to perform any of the methods disclosed herein. A central processing unit (CPU) is coupled to system bus. The CPU may be any general-purpose CPU, although other types of architectures of CPU (or other components of exemplary system) may be used as long as CPU (and other components of system) supports the inventive operations as described herein. The CPU may contain two or more microprocessors and may be a system on chip (SOC), digital signal processor (DSP), application specific integrated circuits (ASIC), and field programmable gate array (FPGA). The CPU may execute the various logical instructions according to disclosed aspects and methodologies. For example, the CPU may execute machine-level instructions for performing processing according to aspects and methodologies disclosed herein.

The computer system may also include computer components such as a random access memory (RAM), which may be SRAM, DRAM, SDRAM, or the like. The computer system may also include read-only memory (ROM), which may be PROM, EPROM, EEPROM, or the like. RAM and ROM, which may also include NAND flash and/or NOR flash, hold user and system data and programs, as is known in the art. The computer system may also include an input/output (I/O) adapter, a graphical processing unit (GPU), a communications adapter, a user interface adapter, and a display adapter. The I/O adapter, the user interface adapter, and/or communications adapter may, in certain aspects and techniques, enable a user to interact with computer system to input information.

The I/O adapter preferably connects a storage device(s), such as one or more of hard drive, compact disc (CD) drive, floppy disk drive, tape drive, etc. to computer system. The storage device(s) may be used when RAM is insufficient for the memory requirements associated with storing data for operations of embodiments of the present techniques. The data storage of the computer system may be used for storing information and/or other data used or generated as disclosed herein. The communications adapter may couple the computer system to a network (not shown), which may include the network for the wellbore and a separate network to communicate with remote locations), which may enable information to be input to and/or output from system via the network (for example, a wide-area network, a local-area network, a wireless network, any combination of the foregoing). User interface adapter couples user input devices, such as a keyboard, a pointing device, and the like, to computer system. The display adapter is driven by the CPU to control, through a display driver, the display on a display device.

The architecture of system may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may use any number of suitable structures capable of executing logical operations according to the embodiments.

As may be appreciated, the method may be implemented in machine-readable logic, such that a set of instructions or code that, when executed, performs the instructions or operations from memory. By way of example, the computer system includes a processor; an input device and memory. The input device is in communication with the processor and is configured to receive input data associated with a subsurface region. The memory is in communication with the processor and the memory has a set of instructions, wherein the set of instructions, when executed, are configured to: perform certain operations.

It should be understood that the preceding is merely a detailed description of specific embodiments of the invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. As such, it will be apparent, however, to one skilled in the art, that many modifications and variations to the embodiments described herein are possible. All such modifications and variations are intended to be within the scope of the present invention, as defined by the appended claims.

The invention claimed is:

1. A method of communicating data among a plurality of communication nodes, the method comprising:

obtaining well data for a subsurface region of a wellbore;

determining a communication network based on the obtained well data, wherein the communication network includes a plurality of communication nodes;

installing at least one of the plurality of communication nodes on a length of drill pipe, wherein the at least one of the plurality of communication nodes is configured to obtain measurements associated with a gravel pack location and to transmit the measurement data to other communication nodes in the communication network, and wherein a gravel pack system is disposed at the gravel pack location;

installing at least some of the plurality of communication nodes spaced apart along a length of production tubing;

performing gravel pack operations to install a gravel pack at the gravel pack location, wherein the performing gravel pack operations include:

obtaining measurements near the gravel pack location with the at least one of the plurality of communication nodes installed on the drill pipe during the gravel pack operations;

transmitting data packets associated with the obtained measurements from the at least one of the plurality of communication nodes installed on the drill pipe to a control unit via the communication network during the gravel pack operations; and monitoring the wellbore during hydrocarbon operations subsequent to completion of gravel pack operations with the at least some of the plurality of communication nodes spaced apart along the length of production tubing, the drill pipe being removed subsequent to completion of gravel pack operations.

2. The method of claim 1, further comprising adjusting gravel pack operations based on the transmitted data packets associated with the obtained measurements.

3. The method of claim 1, further comprising determining voids or gaps in the gravel pack during the gravel pack operations.

4. The method of claim 1, further comprising identifying one or more properties of the wellbore and the gravel pack location for the gravel pack installation.

5. The method of claim 1, further comprising configuring the plurality of the communication nodes based on a communication network configuration.

6. The method of claim 5, wherein the communication network configuration comprises selecting one of one or more frequency bands, one or more individual tones, one or more coding methods, and any combination thereof.

7. The method of claim 1, further comprising producing hydrocarbons from the wellbore through the gravel pack.

8. The method of claim 1, wherein the transmitting data packets comprises transmitting high-frequency signals that are greater than (>) 20 kilohertz.

9. The method of claim 1, wherein the transmitting data packets comprises transmitting high-frequency signals that are in the range between greater than 20 kilohertz and 1 megahertz.

10. The method of claim 1, wherein the performing gravel pack operations comprise:

providing the gravel pack system that includes one or more sand screens;

passing a carrier fluid into the wellbore;

disposing the gravel or the gravel pack proppants adjacent to one or more sand screens to form the gravel pack; and conducting away a remaining portion of the carrier fluid through the one or more sand screens.

11. The method of claim 10, further comprising:

conditioning drilling fluid to remove solid particles from the drilling fluid; and combining the gravel or gravel pack propellants with the conditioned drilling fluid, wherein the conditioned drilling fluid is one of a solids-laden oil-based fluid, a solids-laden non-aqueous fluid, and a solids-laden water-based fluid.

12. The method of claim 1, further comprising:

obtaining measurements near the gravel pack location with one of the one or more communication nodes during the hydrocarbon operations; and transmitting data packets associated with the obtained measurements from the one of the one or more communication nodes to the control unit via the communication network during the hydrocarbon operations.

13. The method of claim 1, further comprising determining fluid composition near the gravel pack location with one of the one or more communication nodes based on the measured data.

14. The method of claim 1, further comprising determining pressure near the gravel pack location with one of the one or more communication nodes based on the measured data.

15. A hydrocarbon system, comprising:

a wellbore having a length of production tubing disposed therein;

a communication network that includes a plurality of communication nodes, wherein;

the hydrocarbon system has a first configuration in which at least one of the plurality of communication nodes is installed on a length of drill pipe disposed in the wellbore, and is configured to obtain measurement data associated with a gravel pack system disposed at a gravel pack location and to transmit the measurement data to other communication nodes in the communication network during gravel pack operations, the gravel pack operations being performed to install a gravel pack at the gravel pack location, wherein the measurement data is obtained near the gravel pack location with the at least one of the plurality of communication nodes installed on the drill pipe during the gravel pack operations, and wherein data packets associated with the obtained measurement data are transmitted from the at least one of the plurality of communication nodes installed on the drill pipe to a control unit via the communication network during the gravel pack operations; and the hydrocarbon system has a second configuration in which at least some of the plurality of communication nodes are installed spaced apart along a length of production tubing in the wellbore, and wherein the wellbore is monitored during hydrocarbon operations subsequent to completion of gravel pack operations with the at least some of the plurality of communication nodes spaced apart along the length of production tubing, the drill pipe being removed subsequent to completion of gravel pack operations.

16. The system of claim 15, wherein the plurality of communication nodes are configured to transmit high-frequency signals that are greater than (>) 20 kilohertz.

17. The system of claim 15, wherein the plurality of communication nodes are configured to transmit high-frequency signals that are in the range between greater than 20 kilohertz and 1 megahertz.

18. The method of claim 1, wherein the obtaining measurements comprises measuring pressure, temperature, gamma ray, flow meter, resistivity, capacitance, stress, strain, density, vibration, or any combination thereof.

19. The method of claim 1, wherein the one or more communication nodes comprise distributed sensors and/or acoustic sensors.

20. The method of claim 1, wherein the obtained measurements comprise a determined flux, fluid flow, and/or fluid composition prior to transmitting the data packets.

* * * * *